US008297536B2

(12) United States Patent
Ruda

(10) Patent No.: US 8,297,536 B2
(45) Date of Patent: Oct. 30, 2012

(54) SPRAY GUN CONTAINER AND METHOD OF PRODUCING A COVER

(76) Inventor: Martin Ruda, Ostfildern (DE)

( * ) Notice: Subject to any disclaimer, the term of this patent is extended or adjusted under 35 U.S.C. 154(b) by 190 days.

(21) Appl. No.: 12/275,825

(22) Filed: Nov. 21, 2008

(65) Prior Publication Data

US 2009/0072050 A1 Mar. 19, 2009

Related U.S. Application Data

(63) Continuation of application No. 11/145,576, filed on Jun. 3, 2005, now abandoned, which is a continuation-in-part of application No. PCT/DE03/04058, filed on Dec. 9, 2003.

(30) Foreign Application Priority Data

Dec. 10, 2002 (DE) ..... 102 57 806
Apr. 3, 2003 (DE) ..... 103 15 426
Jun. 3, 2003 (DE) ..... 103 25 247

(51) Int. Cl.
*B05B 7/30* (2006.01)

(52) U.S. Cl. ..... 239/345; 239/590; 220/375; 215/306

(58) Field of Classification Search ..... 239/345, 239/346, 394, 365, 373, 590; 220/375; 215/306
See application file for complete search history.

(56) References Cited

U.S. PATENT DOCUMENTS

| | | | | |
|---|---|---|---|---|
| 2,323,618 | A * | 7/1943 | Ottoson | 137/564.5 |
| 2,612,404 | A * | 9/1952 | Andersson | 239/345 |
| 3,524,589 | A | 8/1970 | Pelton, Jr. | |
| 4,411,387 | A * | 10/1983 | Stern et al. | 239/345 |
| 5,069,389 | A | 12/1991 | Bitsakos | |
| 5,582,350 | A | 12/1996 | Kosmyna et al. | |
| 6,053,429 | A | 4/2000 | Chang | |
| 7,416,140 | B2 * | 8/2008 | Camilleri et al. | 239/321 |
| 2004/0217201 | A1 | 11/2004 | Ruda | |
| 2006/0000927 | A1 | 1/2006 | Ruda | |

FOREIGN PATENT DOCUMENTS

| | | | |
|---|---|---|---|
| CH | 653 574 | | 1/1986 |
| CH | 688 082 | A5 | 5/1997 |
| DE | 534 273 | | 9/1931 |
| DE | 69 22 879 | U | 5/1969 |
| DE | 29 44 653 | A1 | 5/1981 |
| DE | 80 24 829 | U1 | 9/1982 |
| DE | 35 17 122 | C1 | 5/1986 |
| DE | 87 02 559 | U1 | 10/1987 |
| DE | 44 16 939 | A1 | 11/1995 |
| DE | 695 25 671 | T2 | 8/2002 |
| DE | 202 11 016 | U1 | 11/2002 |
| DE | 102 13 715 | A1 | 5/2003 |
| DE | 29 825 015 | U1 | 4/2004 |
| EP | 0 211 695 | A | 2/1987 |

(Continued)

*Primary Examiner* — Christopher Kim

(74) *Attorney, Agent, or Firm* — Henry M. Feiereisen, LLC

(57) ABSTRACT

To make a change of paint colors during painting work easy and thus quick to perform on a spray gun, the invention proposes a spray gun container having a paint holding area, which is accessible essentially through two main openings, and having at least one additional access to the paint holding area, in which the additional access is reclosable by means of a closure means, whereby said closure means is at least partially arranged in the additional access during the closing of the additional access.

15 Claims, 21 Drawing Sheets

FOREIGN PATENT DOCUMENTS

| | | | |
|---|---|---|---|
| EP | 0 492 333 | A1 | 7/1992 |
| EP | 0 678 334 | A | 10/1995 |
| EP | 0 987 060 | A1 | 3/2000 |
| FR | 1 282 085 | A | 1/1962 |
| FR | 2 662 144 | A | 11/1991 |
| FR | 2 736 329 | A | 1/1997 |
| JP | 06 335643 | A | 12/1994 |
| WO | WO 94/22732 | A | 10/1994 |
| WO | WO 98/32539 | A | 7/1998 |
| WO | WO 01/12337 | A1 | 2/2001 |
| WO | WO 02/085533 | A1 | 10/2002 |
| WO | WO 03/045575 | | 6/2003 |
| WO | WO2005/018815 | * | 3/2005 |

* cited by examiner 86
87
82
85
79
83
78
81
88
80B
80A
84
71A
71
70
77
72
69
74
73
75
76

Fig. 7
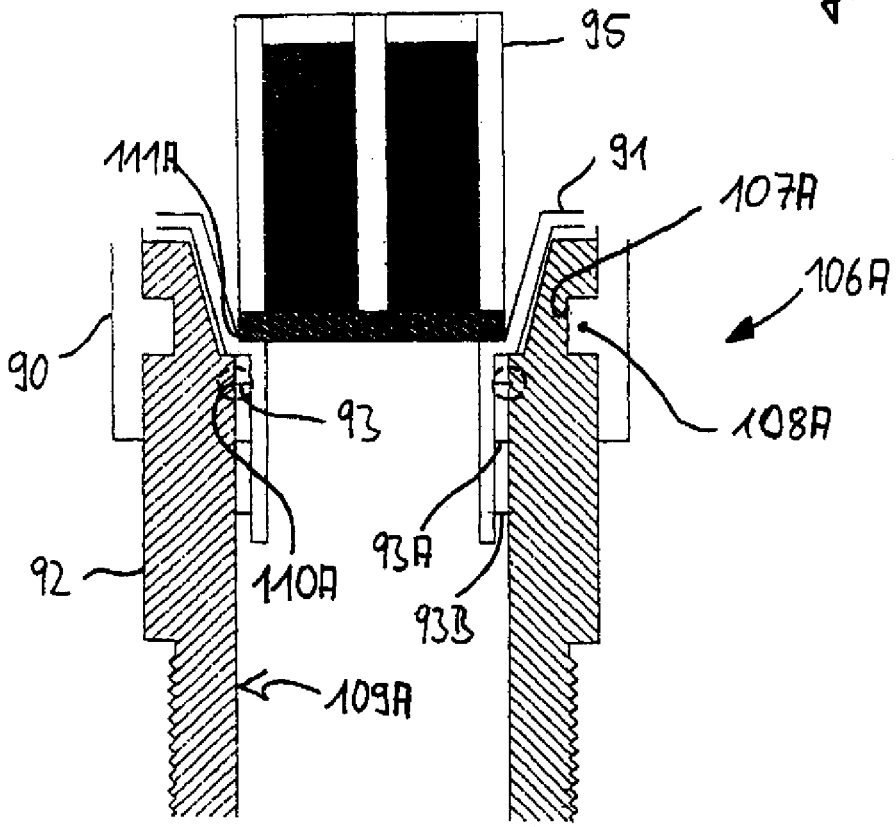
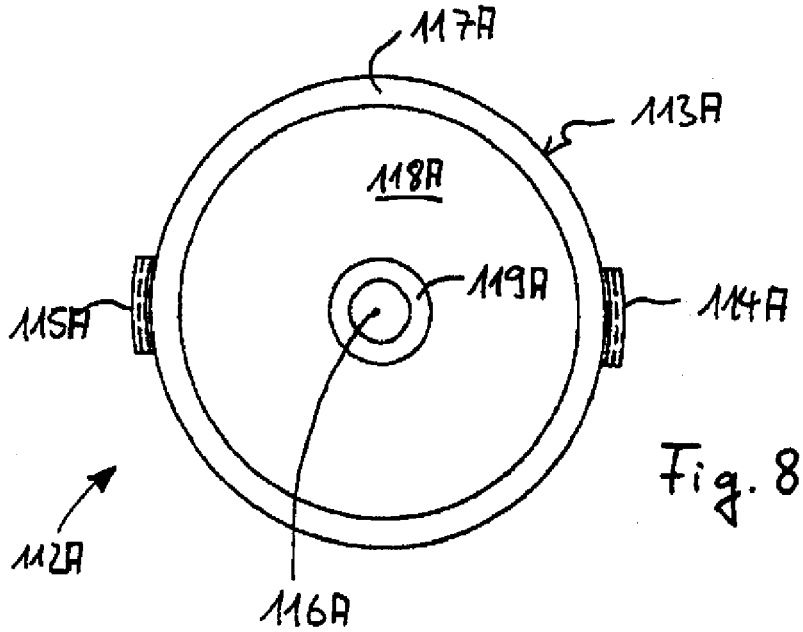
Fig. 8

Fig. 14
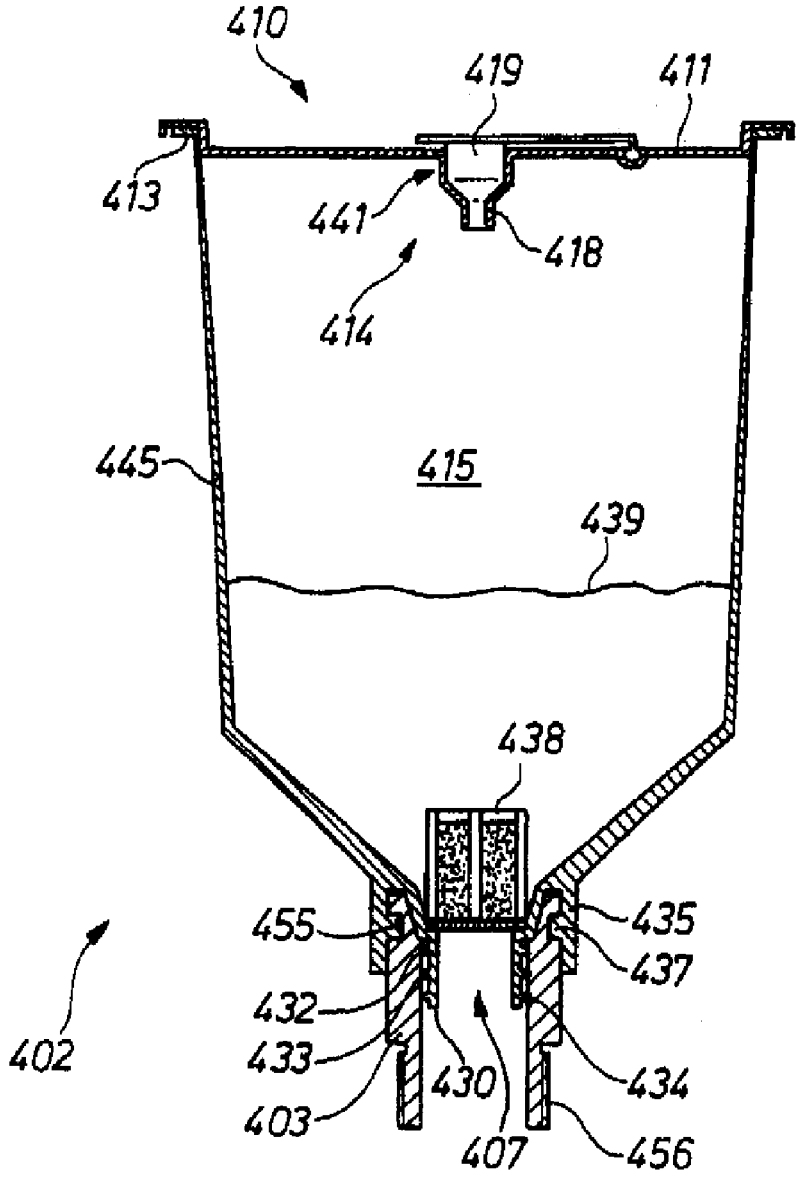
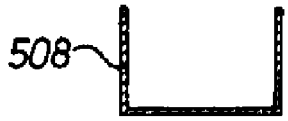
Fig. 15

SPRAY GUN CONTAINER AND METHOD OF PRODUCING A COVER

CROSS-REFERENCES TO RELATED APPLICATIONS

This application is a Continuation of co-pending prior filed Continuation-In-Part application of prior filed copending PCT International Application No. PCT/DE2003/004058, filed Dec. 9, 2003, which designated the United States and is herein incorporated by reference, and on which priority was claimed under 35 U.S.C. §120 and which claimed the priority of German Patent Applications Serial No. 102 57 806.0, filed December 10, Serial No. 2002; 103 15 426.4, filed Apr. 3, 2003; and Serial No. 103 25 247.9, filed Jun. 3, 2003, pursuant to 35 U.S.C. 119(a)-(d).

BACKGROUND OF THE INVENTION

The invention relates to a spray gun container, in particular a single-walled spray gun container, having a paint holding area, which is accessible essentially through two main openings, and having at least one additional access to the paint holding area, whereby the additional access can be resealable by means of a closure means. In addition, this invention relates to a method for producing a cover for sealing a spray gun container and/or a spray gun container insert.

Spray gun containers are used in painting technology and serve to supply a paint, so that enough paint is available to a spray gun during a painting operation.

The state of the art has disclosed a plurality of spray gun containers, some of which have different shapes but also different connecting techniques to meet a wide variety of requirements in the area of paint application. For example, there are so-called flow cups in which a paint that has been stored flows essentially due to the force of gravity into the spray gun. In addition, there are also so-called suction pots with which, through selected pressure ratios between the spray gun container and the spray gun, a paint then also goes from the spray gun container into the spray gun when the spray gun is held above the spray gun container. Accordingly, such suction pots are usually situated beneath the spray gun.

In addition to the plurality of different spray gun containers, there is at least an equally great variety of different connections with which the spray gun container can be attached to the spray gun.

The known connections for spray gun containers usually have a thread which communicates with a matching thread on a spray gun, establishing a fixed or releasable connection between the spray gun container and the spray gun. One disadvantage of such threaded connections, however, is that attaching the spray gun container to the spray gun by means of a screwing motion is relatively complex.

To counteract this disadvantage, there are already spray gun containers which have a very large thread on their connections so that a spray gun container can be attached to the spray gun by rotating less than one complete turn around its longitudinal axis. However, even this screw operation is still complex because the thread flights must be threaded together.

However, not only is such an arrangement and/or removal of the spray gun container on a spray gun a complex and therefore time-consuming operation, but it is also time-consuming to clean a spray gun container after a painting operation to remove the first paint. Changing paint colors frequently takes a great deal of time to be able to continue a subsequent painting operation with a different color. In particular the intermediate cleaning of a spray gun container and optionally the replacement thereof seem to greatly delay the painting work.

Even if the spray gun containers that are used are not cleaned until after the actual painting operation, the total duration of the painting work is still so long that it is a disadvantage. Ultimately, each used spray gun container must be cleaned after use to remove the paint residues.

In addition to the tedious attachment of spray gun containers to spray guns, traditional spray gun containers also present considerable disadvantages because their openings, such as a pressure-equalizing opening for equalizing the pressure inside the spray gun container during a painting operation, could not be sealed tightly enough in the past. For this reason, it repeatedly occurs that pain unintentionally escapes from the spray gun container despite the "sealed" opening. In addition, a large amount of paint usually escapes unintentionally from the spray gun container into the environment while opening such an opening if the opening has previously come in contact with paint. For these reasons, a spray gun container must be handled cautiously. This is evidently very time-consuming because the tedious handling of known spray gun containers additionally prolongs the preparation for painting but also the entire painting operation and/or the entire painting work.

SUMMARY OF THE INVENTION

The object of this invention is to improve upon known spray gun containers so that it is possible to change paint in a spray gun container and in particular a spray gun more rapidly and more conveniently.

The object of this invention is achieved by a spray gun container having a paint holding area which is accessible essentially through two main openings and having at least one additional access to the paint holding area, whereby the additional access can be resealed by means of a closure means and the closure means is arranged at least partially in the additional access during the closing of the additional access.

The term "additional access" in the sense of this invention describes any secondary openings of a spray gun container which connect in addition to the two main openings, the paint holding area of the spray gun container to the environment of the spray gun container. The additional access is consequently another opening of the spray gun container. In particular the term "additional access" is understood to refer to any secondary openings on a spray gun container, in particular on a spray gun container having a single wall, said openings providing air access to the paint holding area and/or a refilling opening of the paint holding area for a paint. The paint holding area here describes the interior of the spray gun container in which a paint is stored.

The term "main opening" of a paint holding area describes first of all a connecting opening through which a paint goes out of the paint holding area to a spray gun. In addition, the term "main opening" also describes a spray gun container opening which is usually opposite this connecting opening and through which a paint is added to the spray gun container or through which the paint holding area of the spray gun container is cleaned.

The additional access is implemented in a particularly simple design, for example, by removing material in a part adjacent to the paint holding area. Through such a means of sealing an additional access, it is possible for the first time to securely close a spray gun container having a single wall so that preparation for work can be performed much more easily and more rapidly. For example, in particular a spray gun container that functions according to the flow cup principle can be used in preparation for work, e.g., in attaching the container to a spray gun or in attaching it to an adapter "on its head." The controller mechanism described above ensures that no paint will escape here from a closed air supply which is situated at the bottom when the spray gun container is placed upside down. The term "at the bottom" as used here describes a condition in which the air supply is on the side of the spray gun container facing the bottom. In addition, even mixing of a two-component paint can be performed in a spray gun container with no problem. Use of the spray gun container as a storage container for a paint or paint residues is also possible to advantage because the additional supply can be closed reliably and permanently. The closing of the single-walled spray gun container which is especially reliable in operation is preferably accomplished by providing a closure means at least partially in the additional access of the paint holding area. Due to the fact that the closure means is arranged at least partially in the additional access, i.e., protrudes into the additional access, this effectively for the first time prevents larger quantities of paint which have previously come in contact with the closure means from escaping from the paint holding area when the closure means is removed from the additional access.

The additional access is particularly easily and reliably closed in terms of the design when the access has a channel. In a first variant, this channel protrudes into the paint holding area, but it need not do so. In particular when the present spray gun container is also used as a mixing container in which a two-component paint is mixed, for example, it is possible to omit the step whereby the channel protrudes into the paint holding area so as not to have a negative effect on a mixing device. Otherwise such a protrusion into the area is advantageous because the channel inlet of the access protrudes beyond the other internal beaker border. This reduces the risk that the channel inlet might come in direct contact with a paint, in particular with paint residues, when the spray gun container is placed on its head. This prevents a paint from reaching the access and/or the channel due to a capillary effect. This is particularly advantageous when the spray gun container in question is used continuously as a supply container because this prevents paint from escaping to the outside through the additional channel due to a capillary effect and since the risk of drying of the paint in the gap between the closure means and the additional access is also reduced. This prevents the sealing stopper from "sticking" in the additional access due to paint drying there so that the paint is difficult or impossible to remove.

It is self-evident that the additional access can be provided through practically any opening in the single-walled spray gun container which connects the paint holding area with the outside area of the single-walled spray gun container. It has been found that a cylindrical or conical channel cross section in particular constitutes an additional access that can be closed off especially well. The channel therefore forms a type of tube into which the closure means is inserted. The additional access is thus closed especially securely.

In this context, it is advantageous if the closure means has a sealing stopper which corresponds to the channel. If the sealing stopper closes the additional access, the sealing stopper is arranged in the channel in such a way that it protrudes at least partially into the channel. Thus the additional access is closed especially reliably. It is self-evident that the additional access can also be closed by closure means of a different design which are situated inside the additional access. At this point, reference is made only as an example to the possibility of providing a slide within the additional access to close it.

According to one embodiment, the closure means has an outside diameter which corresponds essentially to an inside diameter of the channel. This ensures easy insertion of the sealing stopper into the channel on the one hand while on the other hand the channel is closed especially well by the closure means because then a type of press fit is achieved between the closure means and the channel.

A particularly intimate connection between the closure means and the walls of the access is achieved when the closure means has a slightly larger outside diameter than the inside diameter of the channel. In order for the closure means to nevertheless be insertable relatively easily into the channel, it is advantageous if the closure means is manufactured from a material which is different from the material of which the access is manufactured.

According to another embodiment, the additional access ends with an outside border of the single-walled spray gun container or is recessed behind the outside border. Such an additional access, which is terminated with the outside border of the spray gun container or is recessed behind the outside border of the spray gun container, makes it possible for the single-walled spray gun container not to have any unwanted protruding or projecting parts on its surface. This is especially advantageous in areas of the single-walled spray gun container which form a supporting surface with which the single-walled spray gun container is placed on a substrate, e.g., in work preparation for mixing or during a painting process for replenishing the paint supply.

According to a preferred embodiment, the single-walled spray gun container has a connection for arranging the single-walled spray gun container on a spray gun on a first side and the additional access is situated on a side of the single-walled spray gun container facing away from the former connection. Arranging the additional access on the side facing away from the connection is advantageous because when using the single-walled spray gun container in the sense of a flow cup, the additional access serves especially suitably as an air supply to the paint holding area of the single-walled spray gun container. It is self-evident that regardless of that, the additional access may be provided at almost any desired location in the single-walled container, depending on the type of design of the single-walled spray gun container. Since the single-walled spray gun container closed especially reliably by means of the closure means arranged at least partially in the additional access, as mentioned above, the present single-walled spray gun container is also especially suitable for being used as a storage container for a paint. To provide additional reliability for arranging the closure means in the access channel, the channel is preferably of a greater length than the wall thickness of a spray gun container wall. Due to such a length, the closure means is advantageously supported much better inside the channel, so that the risk of unintentional loosening of the closure means from the channel is reduced.

If a paint has previously been in contact with an area of the additional access which is in the paint holding area, it is especially advantageous that when removing the closure means from the additional access, only a very small amount of the paint, if any at all, gets outside of the paint holding area. This is due to the fact that the sealing stopper advantageously comes in contact with the paint only on its end facing the paint holding area. This reduces the risk of an unnecessarily large amount of paint adhering to the closure means, which then goes outside the single-walled spray gun container when removing the sealing stopper from the additional access, i.e., when removing the sealing stopper from the supply channel. This is not the case with the traditional closure mechanisms of a single-walled spray gun container. Instead, openings of a traditional single-walled spray gun container are closed with only a cover and/or a cap to which a relatively large amount of paint may adhere. This amount of paint has previously entered the environment of the spray gun container when opening a traditional closure, so there is a relatively great risk of the environment being unintentionally soiled with this quantity of paint. This may also have a negative effect on painting work. Such unintentional escape of a paint is often attributed to the fact that a cap is simply placed on an edge bordering an opening in such a way that parts of this cap reach around this edge on the outside and therefore although there is relatively secure contact between the cap and the edge of the opening, the side of the cap facing the paint is in contact with the paint over a large area, so that when the cap is lifted up from the opening, the paint which still adheres to the inside of the cap enters the environment of the spray gun container.

This is prevented in the present case because not only does the closure means close the additional access from the outside but also it is situated directly in the additional access, which ensures particularly reliable closing of the additional access. In addition, the closure means, arranged directly inside the access, comes in contact with the paint over only a "small" end face area. The term "small" here describes an end face of the closure means having a diameter that corresponds essentially to the inside diameter of the additional access. This is not the case with traditional closures because they do not close an access of a secondary opening within the access and/or are not situated within the access but instead merely cover an access opening.

Another simplification with regard to a rapid change of paint occurs when the single-walled spray gun container has at least one cover, preferably two covers, for closing the single-walled spray gun container.

In this variant, these single-walled spray gun container has a first upper cover which is mounted on a side of the single-walled spray gun container facing away from the spray gun. Secondly, the single-walled spray gun container has another lower cover which is situated on a side of the single-walled spray gun container facing the spray gun.

The single-walled spray gun container can be closed completely by the first upper cover and by the additional lower cover so that it may also be used as a storage container for paint, if needed, in an advantageous manner. It is thus possible for several single-walled spray gun containers filled with different paints to be kept on hand before or during a painting process, so that a paint color change can be performed especially rapidly with this spray gun.

It has been found that it is advantageous if at least one of the covers has the additional access or a similarly closable passage. To be able to prepare the single-walled spray gun container so that it is ready for use in the shortest possible period of time, it is particularly advantageous if such a reclosable passage is provided on the first upper cover. This closable passage is at first closed, for example, when the single-walled spray gun container is prepared with a paint filled into it. If the single-walled spray gun container and the paint filled into it are needed for the painting process, then first the additional lower cover is removed from the single-walled spray gun container so that the single-walled spray gun container having this opening can be arranged on the spray gun.

To simplify the mounting, the single-walled spray gun container may have a catch-type connection, as described in greater detail below, which makes it possible to attach the single-walled spray gun container to a corresponding receptacle in an uncomplicated manner and within the shortest possible period of time.

Then the reclosable passage on the first upper cover is opened so that there is a pressure equalization in the interior of the single-walled spray gun container due to air flowing in while the paint is being removed.

The term "cover" describes essentially a structure with which the single-walled spray gun container is closed so that a paint in the single-walled spray gun container does not unintentionally leak out of it. Both the first upper cover and the additional lower cover of the single-walled spray gun container thus constitute a closure for the single-walled spray gun container with which it can be closed completely. It is self-evident in this context that the two covers can be attached to the single-walled spray gun container by different methods. For example, the covers can be screwed on. However, the covers are preferably simply clipped onto an edge of the single-walled spray gun container.

According to one embodiment, at least one cover is directly molded onto the single-walled spray gun container. This creates the possibility of having the cover always attached to the single-walled spray gun container, thus eliminating the risk of inadvertent misplacement of the cover.

It is self-evident that in addition to the directly molded cover, there may be other possible connections between the cover and the single-walled spray gun container. For example, the cover may be attached to the single-walled spray gun container by a long strap accordingly.

The term "reclosable passage" may be represented by a simple hole in the form of an area punched out of the cover. Ideally, this hole is provided in the actual process of injection molding of the cover.

However, to reduce the risk of paint unintentionally going from the inside area of the single-walled spray gun container through the reclosable passage into the environment when opening the reclosable passage, it is advantageous if the reclosable passage has a collar which protrudes into the single-walled spray gun container at least when the cover is properly arranged on the single-walled spray gun container.

In this context, it is advantageous if the height of the collar of the reclosable passage essentially perpendicular to its diameter is greater than the thickness of the material of the cover. This in particular greatly restricts the unintentional escape of paint out of the interior of the single-walled spray gun container through the reclosable passage or eliminates it entirely.

In addition, such a collar imparts an improved stability to the cover so that the cover can be placed more rapidly on the single-walled spray gun container.

To further reduce the risk of unintentional escape of paint, it is advantageous if the additional access has a conical channel or if the reclosable passage of the cover has a conical collar. By means of the conical collar, the reclosable passage has a taper so that the risk of unintentional escape of paint is further reduced. The terms "additional access" and "reclosable passage" are used essentially as synonyms in the sense of the present invention. If a secondary opening is provided directly in a spray gun container in the present case, then this secondary opening is preferably referred to by the term "additional access." However, if the secondary opening is provided in the cover of the spray gun container, then this is preferably referred to as a "reclosable passage."

According to a preferred variant in this context, the reclosable passage tapers in the direction of a passage opening facing the cover to a passage opening facing away from the cover.

According to a preferred variant, at least one cover has a depression with a reclosable passage being arranged in the depression. The depression advantageously makes is possible for a closure to be pre-centered when closing the reclosable passage. In this way, for example, an especially narrow area of a stopper can be inserted much more easily into the reclosable passage.

This also greatly simplifies the closing of the reclosable passage, so that now a paint color change on a spray gun can also be performed much more easily and much faster.

In general it has been found that it is advantageous if an inside diameter of a passage opening facing away from the cover amounts to less than 80% or less than 50%, preferably less than 30% of the inside diameter of a passage opening facing the cover. Due to such a larger inside diameter, it is possible in particular to attach a closure to the reclosable passage more easily and thus more rapidly and thus to close the inside diameter of the passage opening facing the cover in an advantageous manner.

If this advantage is to be applied to a cover having a depression, then consequently it is advantageous if an inside diameter of the closable passage amounts to less than 80% or less than 50%, preferably less than 30% of the inside diameter of the depression.

As already mentioned above, a stopper is needed for closing the closable passage. Consequently, it is advantageous if the closable passage has a stopper.

To be able to insert the stopper especially easily and therefore especially rapidly into the closable passage and also be able to ensure that as little paint as possible escapes from the interior of the single-walled spray gun container into the environment of the single-walled spray gun container when the closable passage is opened, it is advantageous for the stopper to be arrangeable in the depression as well as in the closable passage.

In addition, it is advantageous if the stopper has different diameters. The different diameters of the stopper preferably correspond to the inside diameters of the depression and/or the reclosable passage so that the stopper can be inserted with no problem into the reclosable passage.

To reduce the risk of loss of the stopper, it is advantageous if the cover has a nipple on which a stopper for sealing the passage can be situated.

As an alternative to this, the stopper may also be directly molded onto the cover. Thus the cover of the single-walled spray gun container and the stopper of the cover can be manufactured especially inexpensively.

In addition, it is also advantageous if at least one cover is directly molded onto the single-walled spray gun container. To reduce the risk of loss of a spray gun container cover, it is advantageous if the cover is provided on the single-walled spray gun container from the beginning.

At this point it should be mentioned that the features regarding the cover of the single-walled spray gun container are also advantageous even without the other features of the invention because these features already allow a rapid change of paint color on the spray gun. In particular through the cover described here it is possible for the first time to use a single-walled spray gun container as a storage container for paint or to mix a two-component paint in such a container.

In addition, changing the paint color in a spray gun is also greatly simplified and thus accelerated if a connection of the single-walled spray gun container to a receptacle of a spray gun can be attached with a catch.

Due to the catch-type attachment option, the single-walled spray gun container is arranged so it can be attached to a spray gun so that replacing the single-walled spray gun container can be performed particularly rapidly and conveniently. In this way for example a paint color can be changed very quickly during a painting process so that different colors can be applied to a surface very rapidly in succession.

In addition, a catch-type connection is also advantageous when the single-walled spray gun container is designed as a disposable product because the manufacturing requirements made of a catch-type connection are not as high as is the case with a threaded connection, for example. Therefore the cost of manufacturing a single-walled spray gun container having a catch-type connection is lower than that of a connection whose manufacture is more complex.

Such a catch-type connection is especially easy to implement in the design if the connection has a tongue and groove.

In the sense of this invention, a "tongue" is understood to refer to a structure which partially or entirely engages in a device provided for this purpose when the single-walled spray gun container is properly attached to a receptacle. Such a tongue can be implemented by one or more "noses" or "rings," for example. In this way the tongue may form a physical unit with the connection or may be implemented by an additional part which is provided on the connection. For example, such an additional part which may form a tongue in the sense of this invention may be a simple O-ring that is detachably but tightly arranged on the catch-type connection of the single-walled spray gun container.

As an alternative or in addition, the catch-type connection of the single-walled spray gun container may also have a groove into which a component engages entirely or partially when the single-walled spray gun container is properly mounted on the receptacle.

The tongue-and-groove connection described above need not necessarily be provided around the periphery of the catch-type connection but instead may be provided only partially on the connection. However, a peripheral tongue-and-groove connection is advantageous because then the single-walled spray gun container can be attached to a corresponding receptacle in almost any desired position.

In the sense of the present invention, the term "receptacle" refers in particular to an area of a spray gun or another component such as an adapter on which the single-walled spray gun container is situated when used normally.

To design the catch-type connection to be particularly secure, it is advantageous if the connection of the single-walled spray gun container has a web at least partially forming a collar around it. In the present case a tight connection can be achieved particularly well by a catch engagement of the web. It does not matter here whether or not the connection is provided with a thread, regardless of whether it is an inside thread or an outside thread, as is customary on the market.

According to another design variant, the web completely surrounds the connection like a collar in order to establish a particularly good connection between the single-walled spray gun container and the spray gun after the catch engagement of the connection.

In this context, it is advantageous if the web is arranged in the form of a ring, preferably a concentric ring around the connection.

The web is preferably made of an elastic material, so that the web has a certain flexibility with respect to other components and therefore the spray gun container can be mounted on a spray gun receptacle especially easily.

Since such a connection has an advantageous effect on changing the paint color in a spray gun, the features with regard to this connection attachable by a catch-type fastening are advantageous even without the other features of the present invention.

To achieve a rapid change of paint color in combination with the use of a disposable spray gun container, it is advantageous if the single-walled spray gun container has different wall thicknesses along its longitudinal axis.

According to an advantageous embodiment here, the single-walled spray gun container has a greater wall thickness on its side facing the spray gun than on its side facing away from the spray gun.

Due to the greater wall thickness selected for the side facing the spray gun, the single-walled spray gun container has a good basic strength such that the single-walled spray gun container can have a much smaller wall thickness on its side facing away from the spray gun without any problem. Due to the smaller wall thickness, the consumption of material is reduced, so that such a single-walled spray gun container can be manufactured much more economically. In addition, this results in much less burden on the environment.

In this connection, it has been found that it is advantageous if the single-walled spray gun container has a wall thickness of less than 3 mm or less than 1.5 mm, preferably less than 0.5 mm in the area of its smallest wall thickness.

In addition, it has been found that the single-walled spray gun container advantageously has a wall thickness greater than 0.4 mm, preferably greater than 1.5 mm, in the area of its greatest material thickness. Due to such a choice of wall thickness, the single-walled spray gun container has a sufficiently great basic strength, so that handling of the single-walled spray gun container remains reliable despite the low wall thickness. This is advantageous in particular for fastening the single-walled spray gun container to a receptacle in a manner that is reliable during operation.

The features with regard to the different wall thicknesses of a spray gun container are advantageous regardless of the other features of the present invention.

To be able to arrange the present single-walled spray gun container on traditional spray guns and also ensure a rapid change of paint color with regard to the use of traditional spray guns, it is advantageous if the single-walled spray gun container has an adapter which can be arranged with a catch-type connection on the single-walled spray gun container.

The adapter has on a first side a receptacle for the connection of the single-walled spray gun container according to this invention and has a connection on the side opposite this first side communicating with the connection of the single-walled spray gun container. Due to the use of such an adapter, the single-walled spray gun container can be manufactured especially advantageously as a universal component which can be mounted on any traditional spray gun.

It has been found that when using an adapter, the paint color can also be changed much more easily and therefore more rapidly on a spray gun if the adapter has a first holding area for the single-walled spray gun container and an additional holding area for the spray gun, and if the first holding area is connected in an articulated joint to the additional area.

In particular due to the fact that the first holding area and the additional receptacle are joined together with an articulated joint, the single-walled spray gun container can also be arranged quickly and conveniently on a spray gun if the receptacle of the spray gun is not optimally arranged with respect to the connection of the single-walled spray gun container. In addition, this yields the advantage that a single-walled spray gun container arranged on a spray gun by means of the articulated adapter can be aligned much better in painting work so this reduces the risk of paint inadvertently coming out of the closable passage in the cover. Instead, the single-walled spray gun container can be aligned much more flexibly with respect to the spray gun by means of the articulated adapter so that a connection between the two components can be established more rapidly.

To reliably seal the articulated adapter at the interface between the first holding area and the additional holding area with respect to paint, it is possible to manufacture and machine the adapter with particular care at this interface.

One variant that has a particularly simple design advantageously involves providing an additional paint line, preferably flexible tubing, between the first holding area and the additional holding area. Due to the additional paint line, no particularly high demands need be made of the manufacture of the articulated interface between the two holding areas because the paint goes from the spray gun container at least in the area of the rotating joint through the additional paint line to the spray gun.

In this connection, it is possible for the additional paint line to be situated in the area of the rotating joint outside of the adapter. To protect the additional paint line from mechanical wear and/or mechanical damage in particular, it is advantageous if the additional paint line is arranged essentially inside the adapter in the area of the rotating joint.

For the sake of thoroughness, it should be mentioned at this point that the features with regard to the articulated adapter are also advantageous independently of the other features of the present invention because the articulated adapter facilitates a rapid change of paint color in a spray gun and also increases the flexibility of the single-walled spray gun container on many levels.

The object of this invention is also achieved independently of the other features of this invention by a spray gun container, preferably a flow cup for holding paints, whereby the spray gun container has a container part and a fixed container insert. According to this invention, the fixed container insert is inserted into the container part of the spray gun container so that the spray gun container part no longer comes in contact with the paints or does so only as an exception.

As mentioned already at the beginning, spray gun containers are known in the state of the art and the spray gun containers are offered by different manufacturers and in different embodiments. A spray gun container here is mounted on a spray gun and can be filled with paints or other coating materials. The spray gun container is an essential part of a spray apparatus in conjunction with the design described here.

Through the present invention, such spray gun containers have advantageously been developed to a further extent because the paint no longer comes directly in contact with the spray gun container but instead comes in contact only with the fixed container insert. Therefore the combination of features of a spray gun container with a container part and a fixed container insert is also advantageous independently of the other features.

The container insert is preferably designed as an inexpensive disposable part, so that time-consuming cleaning processes which are required with a traditional spray gun container may be omitted. When a spraying operation is concluded, the container part including the container insert is removed from the spray gun, for example, and the container insert is removed from the container part without contaminating the container part with coating material.

It is self-evident that it is not absolutely necessary to dispose of the container insert after one painting operation. The container insert is advantageously then also suitable for being cleaned after one painting operation.

If this is the case, it is advantageous to use much less cleaning agent after a spraying operation for cleaning the spray apparatus than is the case with the usual spray equipment, because the coating material that is left over remains in the fixed container insert, which can be replaced easily by another fixed container insert. Several container inserts may optionally be cleaned together at a later point in time, so that consumption of cleaning agent may be reduced.

In particular, this results in a much shorter period of contact with the cleaning agents, such as solvents, for the operating personnel after a painting operation. This improves working conditions to the extent that it yields advantages for the operating personnel with regard to toxic exposure.

Another important advantage provided by the container insert can be seen as the fact that a change in paint color between individual painting operations can be performed much more easily and thus more rapidly and effectively.

When changing paint colors, it is now no longer necessary to clean the spray gun container and thus to prepare it for another painting operation with a different coating material, but instead only the container insert which contains a first coating material need be removed from the container part of the spray gun container and replaced by a different container insert which contains another coating material. The spray gun as well as the adapter may optionally be cleaned by using a cleaning agent from a washing bottle. To eliminate any contamination of the spray gun container, an intermediate cleaning of the container with the cleaning agent from the washing bottle may optionally also be performed.

To remove a container insert from the container part especially easily, it is advantageous if the container insert projects above the top edge of the container part. This makes it possible for the container insert to be gripped by the operator by simply grasping the projecting area and removing it from the container part.

The term "flow cup" or "flow container" is understood to refer to a container which is arranged above the actual spray gun in a painting operation in particular and from which the coating material flows into the spray gun.

It is self-evident that the term "spray gun container" is intended to refer not only to the known flow cups mentioned above, but also to any other containers which are suitable for accommodating coating materials. These include, for example, a suction pot, which may also be situated on a spray gun and represents an alternative container to the flow cup described above in particular.

In conjunction with the present invention, the term "paint" or "coating material" refers to any paint, varnish, lacquer or lacquer-like coating materials which are suitable for being applied to an object by means of a spray gun.

The term "fixed container insert" is understood in the sense of the present invention to refer to a structure which independently retains a shape imparted to it. The container insert may be produced from a variety of materials. An important criterion is that the material used must be at least temporarily solvent-resistant. In particular, plastics such as polypropylene are suitable for this purpose. A fixed container insert guarantees a uniform supply of coating material with respect to a spray gun because then it cannot collapse due to a vacuum that develops with the removal of the coating material. Instead, the shape of the container insert remains rigid even at an advanced stage of removal of coating material from the container. In addition, the fixed container insert can be handled well because it can be gripped reliably. This is advantageous in particular when changing the coating material and in subsequent storage of container inserts.

It is also self-evident that the fixed container insert may be made of materials similar to those also used with traditional spray gun containers. The container insert is advantageously made of materials which can be cleaned to remove the coating materials especially easily.

Due to the container insert which is inserted into the container part of the spray gun container, the overall structure of the spray gun container now has a double wall, so that coating materials can no longer reach the actual spray gun container.

The container insert thus forms an inside wall of the spray gun container. The inside wall can be divided from the outside wall of the spray gun container, so that the advantages already mentioned above can be achieved especially easily.

To secure the container insert with respect to the container part of the spray gun container especially well, it is advantageous if the container part of the spray gun container has a fastening means with which the container insert is secured with respect to the container part. Such a means of securing it is also advantageous because when the container insert is full, it has a relatively great weight, so that it is advantageous if the container insert is secured with respect to the container part of the spray gun container.

It is advantageous here if the fastening means has a coupling ring. A coupling ring is especially suitable for securing the container insert with respect to the container part of the spray gun container, because it can be mounted on the container part of the spray gun container like a traditional spray gun container closure. A thread or a flange which is already provided on the spray gun container and would otherwise accommodate a spray gun container closure can be used for this purpose to advantage.

As an alternative or in addition to the fastening means of the container part, it is advantageous if the container insert of the spray gun container has a fastening device with which the container insert can be secured with respect to the container part.

According to one variant, the fastening device has at least one fastening strap. The container insert advantageously has two fastening straps which communicate with a corresponding groove in the container part at least when installed. This makes it possible to establish an especially secure connection between the container part and the container insert.

It is advantageous that the container insert has at least two openings. A second opening of the container insert is advantageous to prevent a vacuum in the container insert due to removal of the coating material during a painting operation. It is advantageous if this "air following flow opening" is designed so that although air can flow in or follow into the container insert from the outside air, no ingredients and/or coating materials from the container insert can escape to the outside. Therefore, at least one opening may have a valve to ensure this.

To bring the coating materials, which are in the container insert, up to the spray gun, it is advantageous if at least one opening in the container insert communicates with a liquid supply of a spray gun.

It is advantageous here if in the area of at least one first opening, a fastening means with which the container insert can be secured on the spray gun is provided. Suitable fastening means include virtually all devices with which a frictionally locked, form-fitting or force-locked connection can be established between the container insert and the spray gun. These may include, for example, traditional fast closures, bayonet closures, screw closures or plug closures. It is self-evident that the fastening means and/or the connecting possibilities are not limited to the devices mentioned here.

In addition, it is also advantageous if at least the first opening has a closure. This is especially advantageous, for example, when a coating material has not been applied completely in one operation and must now be stored inside the container insert. In particular the plug devices, screw devices, stopper devices or reverse drawing devices which are capable of guaranteeing a secure and reliable closure of these openings are suitable for closing and opening of a container insert.

The area around the opening, in particular around the first opening, is optionally designed so that this area is a type of cylindrical tube or the like. For example, a thread may easily be provided on such an area, thus implementing one possibility of connection to the spray gun and/or a closure device.

According to one embodiment, a screen is provided at least in the area of one opening. In particular for the case when coating materials that have not been pre-screened are used for processing, it is advantageous if a screen is provided, e.g., at the opening, which communicates with the fluid supply of the spray gun or at least faces the fluid supply of the spray gun. This makes it possible for the coating material flowing to the spray gun to be screen before it enters the spray gun.

It is self-evident that such a screen may also be provided in an area of the container insert. For example, the screen is situated on a refilling opening so that a coating material, which is added to the container insert, is screened directly on addition.

According to another variant, the container insert and the screen are designed in one piece. Advantageously the container insert and the screen are manufactured as a single part in an injection-molding operation. This greatly reduces the manufacturing cost because no additional part need be used to filter the coating material. Instead, it is possible to eliminate the external part "screen," which further simplifies handling of a spray gun container with a screen.

The screen is preferably arranged on the opening of the container insert which faces the spray gun, so that the coating material is filtered before it flows directly into the spray gun.

It is advantageous if the screen is situated inside this opening or in front of this opening within the container insert. Either the screen is designed as a three-dimensional structure or as a flat membrane. A three-dimensional screen has the advantage of a larger surface area available for filtering the coating material.

It is also advantageous for simple filling of the container insert or for especially simple cleaning of the container insert if the container insert has a cover for sealing at least one opening. This cover may be attached by snap-on connection, screw-on connection or by some other advantageous means.

In this connection it is advantageous if the cover of the container insert has at least one closable through-hole. By means of this closable through-hole it is possible to ensure that, for example, enough air can flow into the container insert subsequently during the removal of the coating materials.

It is self-evident that the through-hole described here can also be closed with one of the closure devices of the openings of the container insert as already mentioned above.

In particular when changing a container insert, it is advantageous if the through-hole in the cover, which is usually opened during the spraying process, can be closed. The spray gun is usually rotated 180° after sealing the through-hole when changing and/or removing the container part with the container part situated on it and the container insert so that the spray gun is located above the container part and the container insert. Then either the container part including the container insert is released from the spray gun or the container part remains on the spray gun and only the container insert is removed from the container part. Then the container insert may be disposed of or used for storing residues of paint and coating material. In the last variant, the first opening described above is closed with the above-mentioned closure.

To be able to arrange a compressed air tubing, for example, on the spray gun container and/or on the cover of the spray gun container, it is advantageous if the through-hole has a receptacle on which a medium supply device may be arranged. If the compressed air tubing is connected to this receptacle, the spray gun container may also be use to advantage in a low-pressure spraying process.

In addition, it is also possible to provide the receptacle with a length of tubing to facilitate the supply of coating materials into the container insert.

In addition, it is advantageous if the cover is situated on an opening of the container insert which is opposite a container insert opening, the container insert opening being provided in particular for communication with a fluid supply to a spray gun. This makes it possible to implement an especially simple design variant.

To allow the container part together with the container insert to be mounted on different spray guns, it is advantageous if the container insert and/or the container part has/have an adapter which provides a secure but detachable connection between the spray gun and the container part of the spray gun container. In addition, there is also a loose connection between the container insert and the spray gun and/or the adapter.

First of all, this ensures that there is a very intimate and thus very sturdy and secure connection between the spray gun and the container part of the spray gun container, preventing unintentional detachment of the container part from the spray gun. Secondly, a loose but tight connection is created between the container insert and the spray gun and/or the adapter, making it possible to replace different container insert rapidly.

It is self-evident with regard to these features that the adapter may also have connecting devices which include the connection possibilities already described above such as a fast-snap closure, a bayonet closure, a screw closure or a plug closure.

The adapter preferably has a detachable but secure and tight connection with respect to the container part of the spray gun container and also has such a secure and tight connection with respect to the spray gun.

In addition, it is advantageous if the easily detachable and loose connection between the adapter and the container insert is secured by means of an above-mentioned fastening means, preferably in the form of the coupling ring.

This makes it possible to detach the container insert easily and quickly from the adapter and thus remove it from the container part of the spray gun container. For example, then a replacement container insert containing another coating material can again be introduced into the container part and secured in the area of the adapter.

In addition, there is the possibility of releasing the container part and the container insert completely from the spray gun and/or the adapter of the spray gun and replacing it by another container part having a container insert. This is advantageous in particular in the case of multiple paint color changes in succession, because the only the actual spray gun need be cleaned between these changes.

To seal the container insert well, it is advantageous if at least one sealing means, preferably at least one ring gasket is provided in the area of at least one opening. This pertains in particular to the opening, which faces the spray gun fluid supply. Because of the corresponding sealing means, the risk of coating material reaching the container part of the spray gun container is especially low. For example, the sealing means by consist of a plurality of sealing rings which are arranged in the area of the above-mentioned opening and establish a type of pinch connection between the container insert and the inside bore of the adapter.

However, any other tight but rapidly releasable type of connection may also be provided for connecting the container insert rapidly and promptly to the adapter or releasing it from the adapter.

According to a preferred variant, the volume of the container insert has at least more than 60%, preferably more than 80% of the volume of the container part. This also results in optimum utilization of the volume of the spray gun container.

To utilize the volume of the spray gun container especially well, it is advantageous if the container insert has an outside contour that corresponds to the inside contour of the container part.

The object of this invention is also achieved by a method for manufacturing a cover for closing a single-walled spray gun container and/or a spray gun container insert in which the cover and a stopper of a closable passage in the cover are manufactured in a single injection molding operation in such a manner that they are inseparable from one another.

This makes it possible, first, to significantly reduce the manufacturing costs because several components of the spray gun container can be manufactured in a single operation.

In addition, this reduces the risk that a stopper for the closable passage in the cover might unintentionally get lost because the stopper is directly connected to the cover and therefore forms a unit together with the cover.

It is self-evident not only that the aforementioned features are advantageous for the single-walled spray gun container described here but also, with regard to a spray gun container insert which is situated in a spray gun container, it is self-evident that the features are advantageous both individually and when combined together. The features described for the single-walled spray gun container also yield advantages with regard to a spray gun container insert which are identical or at least similar to the advantages achieved with the single-walled spray gun container described here.

BRIEF DESCRIPTION OF THE DRAWING

Other advantages, goals and properties of the present invention are described on the basis of the following discussion of the accompanying drawings, which illustrate spray gun containers with corresponding container inserts as examples. They show.

DETAILED DESCRIPTION OF PREFERRED EMBODIMENTS

Figure 1:
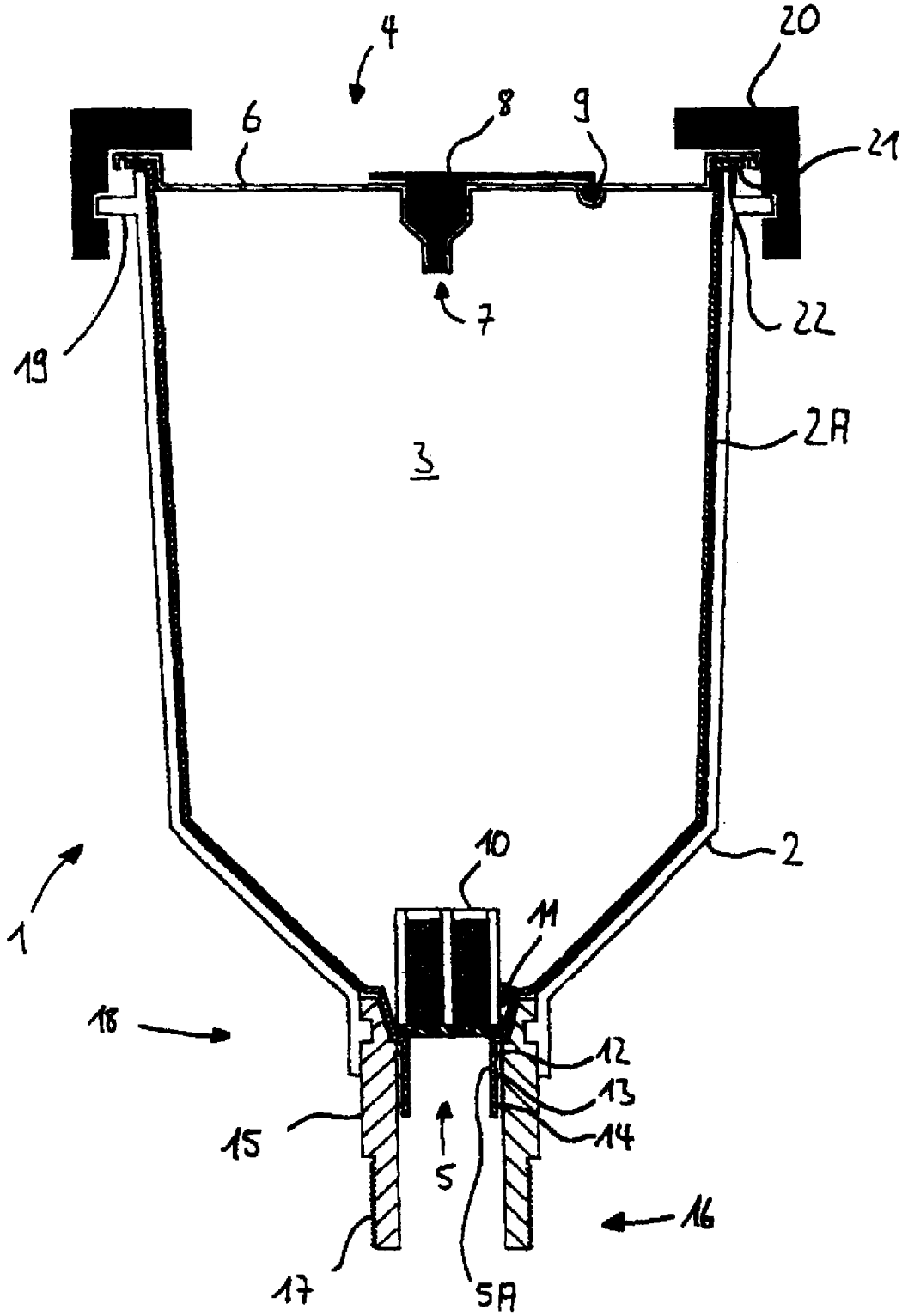
FIG. 1 a schematic sectional side view of a first spray gun container comprising a container part and a container insert, FIG. 2 a second spray gun container having another container part and another container insert and a spray gun in an exploded diagram, FIG. 3 a schematic sectional side view of a spray gun container comprising a container part and a one part container insert, FIG. 4 a schematic exploded diagram of one exemplary embodiment of another spray gun container on a spray gun, FIG. 5 an exemplary embodiment of a schematic sectional view of a spray gun container having a compressed air tubing for a low-pressure spray process, FIG. 6 a schematic sectional side view of a spray gun container having a container part and a container insert loosely connected to the container part, FIG. 7 a schematic detailed view of the loose connection between the container part and the container insert of the spray gun container from FIG. 6, FIG. 8 a schematic top view of a container insert having two opposing fastening straps, FIG. 9 a schematic sectional side view of a spray gun container in which a container insert is loosely connected to a container part by means of two opposing fastening straps, FIG. 10 a schematic sectional side view of the spray gun container from FIG. 9 with an additional coupling ring, FIG. 11 a schematic overall arrangement between a spray gun, an adapter and a single-walled spray gun container having an upper cover and a lower cover, FIG. 12 a schematic sectional side view of a single-walled spray gun container having a web and an upper spray gun container cover, FIG. 13 a schematic diagram of a lower spray gun container cover for the single-walled spray gun container from FIG. 12, FIG. 14 a schematic sectional side view of the single-walled spray gun container from FIG. 12 having an adapter connected thereto, FIG. 15 a schematic diagram of a lower spray gun container cover for closing an adapter connected to the single-walled spray gun container, FIG. 16 a schematic sectional side view of another single-walled spray gun container having a catch-type connection, FIG. 17 a schematic diagram of a catch-type connection of the single-walled spray gun container having a web according to FIG. 6, FIG. 18 a schematic diagram of a first alternative web having a triangular connection for the catch-type connection of the single-walled spray gun container from FIG. 16, FIG. 19 a schematic diagram of another web having a rectangular connection for the catch-type connection of the single-walled spray gun container from FIG. 16, FIG. 20 a schematic diagram of an additional exemplary embodiment of a web having a square connection for the catch-type connection of the single-walled spray gun container from FIG. 16, FIG. 21 an adapter for a single-walled spray gun container, FIG. 22 an adapter having additional catch-type openings for a spray gun container, FIG. 23 an articulated adapter, FIG. 24 an articulated adapter having an additional guided line outside of the adapter, FIG. 25 an articulated adapter having an excess structural height, FIG. 26 a schematic diagram of a sectional side view of another single-walled spray gun container having a spray gun container cover, which has an additional reclosable refilling opening, FIG. 27 a schematic diagram of an overall arrangement of a spray gun and a spray gun container having a spray gun container cover which has a reclosable refilling opening.

The spray gun container 1 shown in FIG. 1 includes a container part 2 and a container insert 2A having a volume 3. The volume 3 is used to accommodate coating materials (not shown here).

The container insert 2A includes two openings 4 and 5, whereby the opening 4 is sealed with a cover 6. The cover 6 itself has an opening 7, which is connected to the cover 6 by means of a closure 8 by using a form-fitting connection 9.

The opening 5 includes a screen 10 with which the coating materials (not shown here) are filtered and/or screened through the opening 5 before leaving the container insert 2A.

The screen 10 is detachably secured on the container insert 2A in area 11, so that the screen 10 can be replaced if needed.

The container insert 2A also has three sealing rings 12, 13 and 14 in the cylindrical area 5A of the opening 5. First, these three sealing rings 12, 13 and 14 seal the interface between the container insert 2A and an adapter 15 with respect to container part 2 of the spray gun container 1. Secondly, the container insert 2A is detachably connected to the adapter 15 in the manner of a pinch connection by means of the three sealing rings 12, 13 and 14.

Figure 2:
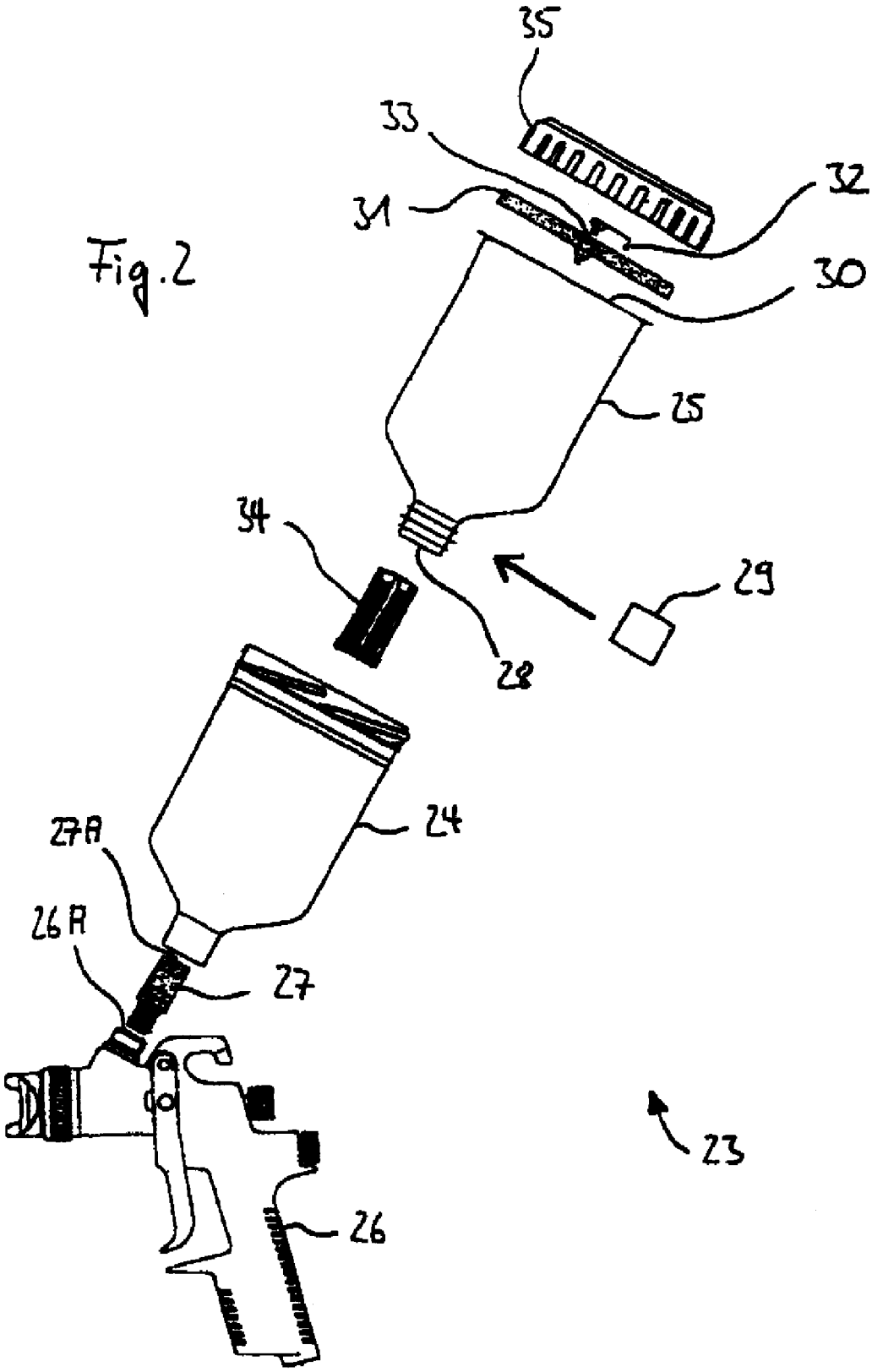

The adapter 15 has a fine thread 17 on one side 16 with which it can be attached to a spray gun (26, see FIG. 2).

The adapter 15 is joined in a form-fitting manner to the container part 2 of the spray gun container 1 on a side 18 of the adapter 15, which is opposite the side 16. This connection is preferably accomplished by means of a known bayonet closure (27A, FIG. 2).

In the area of the upper opening 4, the container part 2 of the spray gun container 1 has an outside thread 19 by means of which the spray gun container part 2 can accommodate a coupling ring 20.

In the tightened state, the coupling ring 20 presses the peripheral edge 21 of the container insert 2A against the upper edge 22 of the spray gun container part 2 and also presses the cover 6 against the peripheral edge 21 of the container insert 2A.

The coupling ring 20 secures not only the container insert 2A with respect to the spray gun container part 2 but also secures the cover 6 with respect to the container insert 2A.

The spray gun container 23 (FIG. 2) includes a container part 24, a fixed container insert 25 and a spray gun 26. The spray gun container 23 is mounted on the spray gun 26 by means of an adapter 27. By replacing the adapter 27 with another adapter (not shown here), it is possible to mount the spray gun container 23 on different spray guns (not shown here).

The container insert 25 includes a sealing cap 29 for its opening 28, which faces the spray gun 26.

Another opening 30 on the container insert 25 is sealed with a cover 31. The cover 31 also has a closure 32 which seals a bore 33 provided in the cover 31.

By means of the sealing cap 29, the opening 28 is sealed when the container insert 25 is not in use, thus permitting simple and reliable storage of coating material (not shown here) within the container insert 25. First, the bore 33 in the cover 31 is closed because the spray gun 26 is upside down to remove the container insert 25, optionally in combination with the container part 24, so that the cover 31 with its bore 33 retains the coating material in the container insert 25.

The container insert 25 also includes a screen 34 that can be arranged in the opening 28 to thus clean a coating material (not shown here), which is flowing through the opening 28.

If the container insert 25 is installed in the container part 24 of the spray gun container 23, the container insert 25 as well as its cover 31 are secured on the spray gun container part 24 by means of a coupling ring 35.

The container insert 25 makes it possible to remove a first coating material (not shown here) rapidly and cleanly from the spray gun container part 24 and to replace it with another container insert (not shown here) without the contents of the container inserts 25 coming in contact with the container part 24 of the spray gun container 23.

Figure 3:
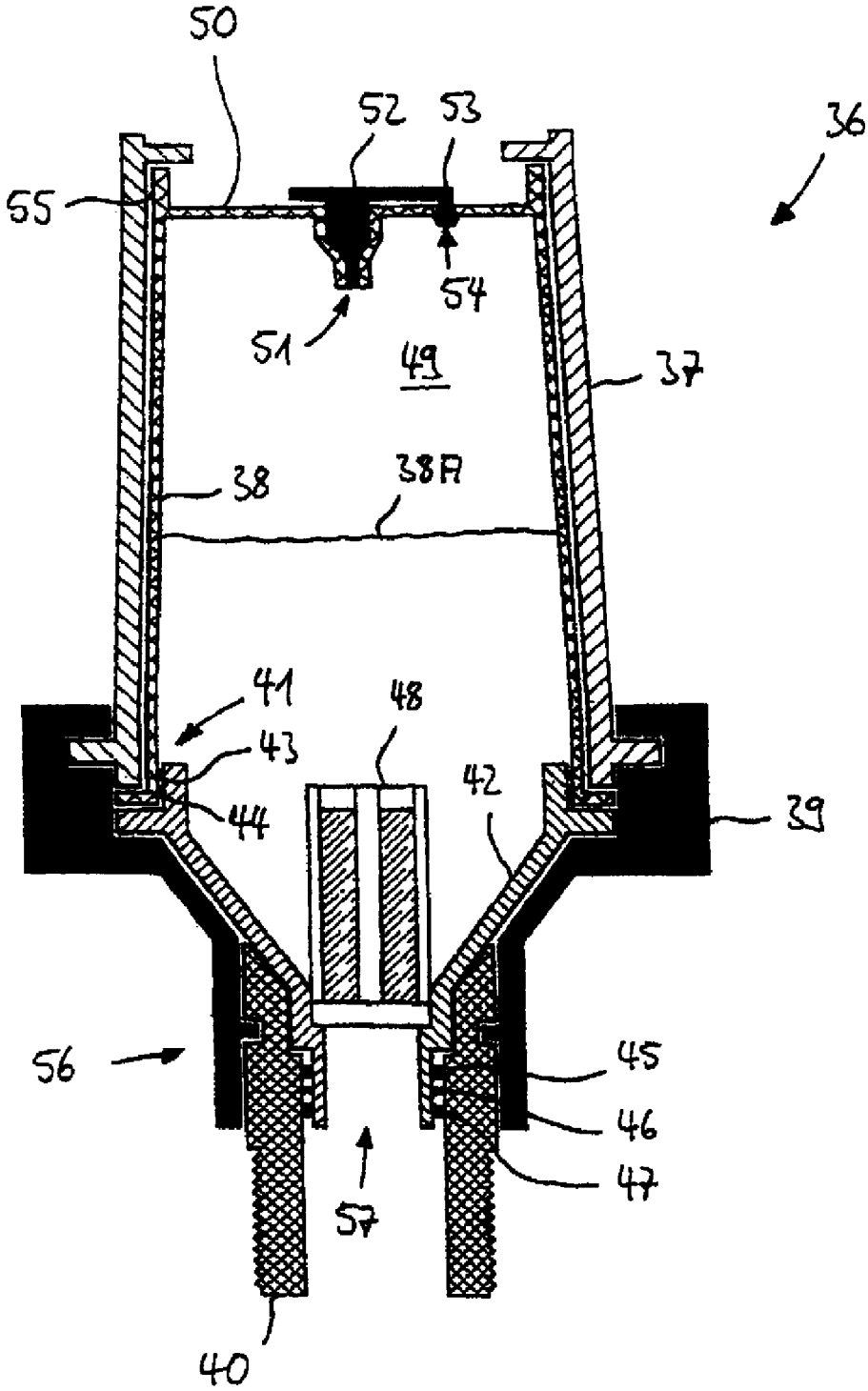

The spray gun container 36 shown in FIG. 3 has an open container part 37 in which a one-piece fixed container insert 38 is arranged. The container part 37 is arranged on an adapter 40 by means of a connector 39. The connector 39 establishes a detachable connection between the container part 37 and the adapter 40 and also clamps the container insert 38 with a first edge area 41 on a funnel part 42 so that the container insert 38 and the funnel part 42 are tight in the area 41. Two sealing rings 43 and 44 are advantageously arranged in area 41, which additionally increases the sealing reliability.

The funnel part 42 has three sealing rings 45, 46 and 47 with respect to adapter 40 so that the funnel part 42 has a loose connection with respect to adapter 40 and also provides a very reliable sealing device.

Figure 4:
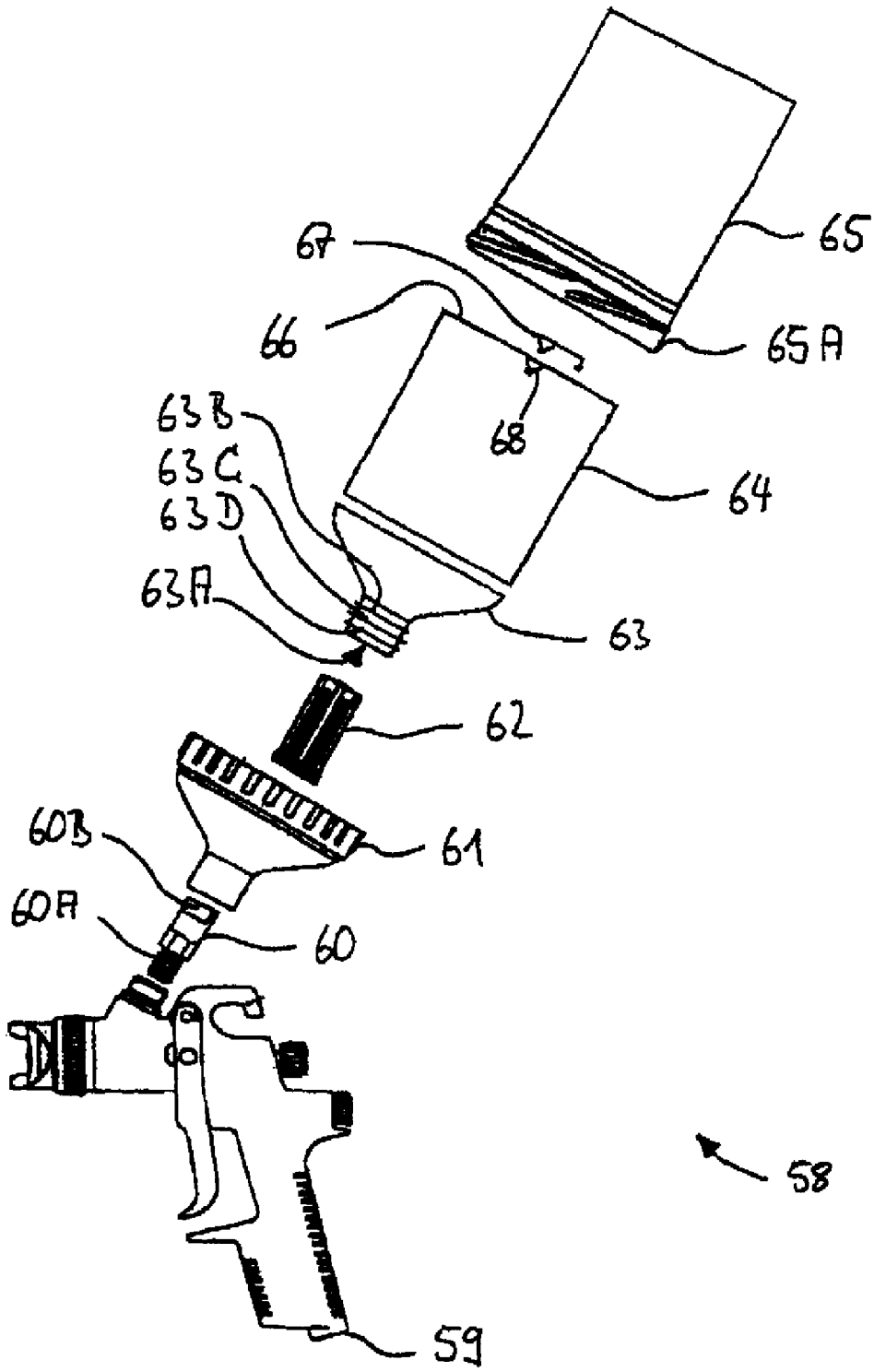

In addition, a screen 48 is provided on the funnel part 42, screening a coating material 38A which flows out of a hollow space 49 of the container part 38 through the funnel part 42 and through the adapter 40 into a spray gun 26 or 59 (see FIGS. 2 and 4).

To prevent a vacuum from developing in the hollow space 49 of container insert 38 due to a coating material 38A flowing out of it, the container insert 38 has an opening 51 in the area of a bottom 50 which can be sealed by means of a closure 52. The closure 52 is fastened by means of a fastening 53 on a borehole 54 in the bottom 50 of the container part.

The container insert 38 has a second edge area in the form of a collar 55 in the area of a bottom 50. By means of the collar 55, the container insert 38 may be placed on a substrate to advantage. Since the collar 55 extends beyond the height of the closure 52, the closure 52 does not prevent secure placement of the fixed container insert 38 on a substrate.

In order to store a coating material 38A in the fixed container insert 38 in the least complicated way possible, for example, the connector 39 is released by a thread 56 of the adapter 40 which faces the container insert 38 so that a connector 39 together with the container part 37, the container insert 38 and the funnel part 42 can be removed from the adapter 40 as a unit. An opening 57 in the funnel part 42 is sealed tightly by means of a closure 29 (see FIG. 2) so that the coating material 38A can be stored well in the fixed container insert 38.

In addition, the fixed container insert 38 can be filled especially advantageous when it is placed on a fixed substrate by means of the collar 55 when the closure 52 is closed and the funnel part 42 is not arranged on it. The fixed container insert 38 can be filled here easily, cleanly and rapidly through its area 41.

The exemplary embodiment 58 illustrated in FIG. 4 includes a spray gun 59, an adapter 60, a connector 61, a screen 62, a funnel part 63 a fixed container 64 and a container part 65.

The fixed container insert 64 includes on its bottom side 66 a closure 67. The closure 67 is provided for closing a borehole 68 in the container insert bottom 66.

The adapter 60 is screwed onto the spray gun 59 by means of a first thread 60A. The connector 61 is mounted on the adapter 60 by means of a bayonet closure 60B.

The screen 62 is arranged in the opening 63A of the funnel part 63, whereby the funnel part 63 is inserted into the connector 61. The funnel part 63 has three ring gaskets 63B, 63C and 63D in the area of the opening 63A, so that a connection between the funnel 63 and the adapter 60 is sealed.

In addition, the fixed container insert 64 is placed in the container part 65. The container part 65 is screwed onto the connector 61 by means of a thread 65A. First, the funnel part 63 is pressed into the adapter and secured there in this way and secondly the fixed container insert 64 is pressed into and secured on the funnel part 63.

Figure 5:
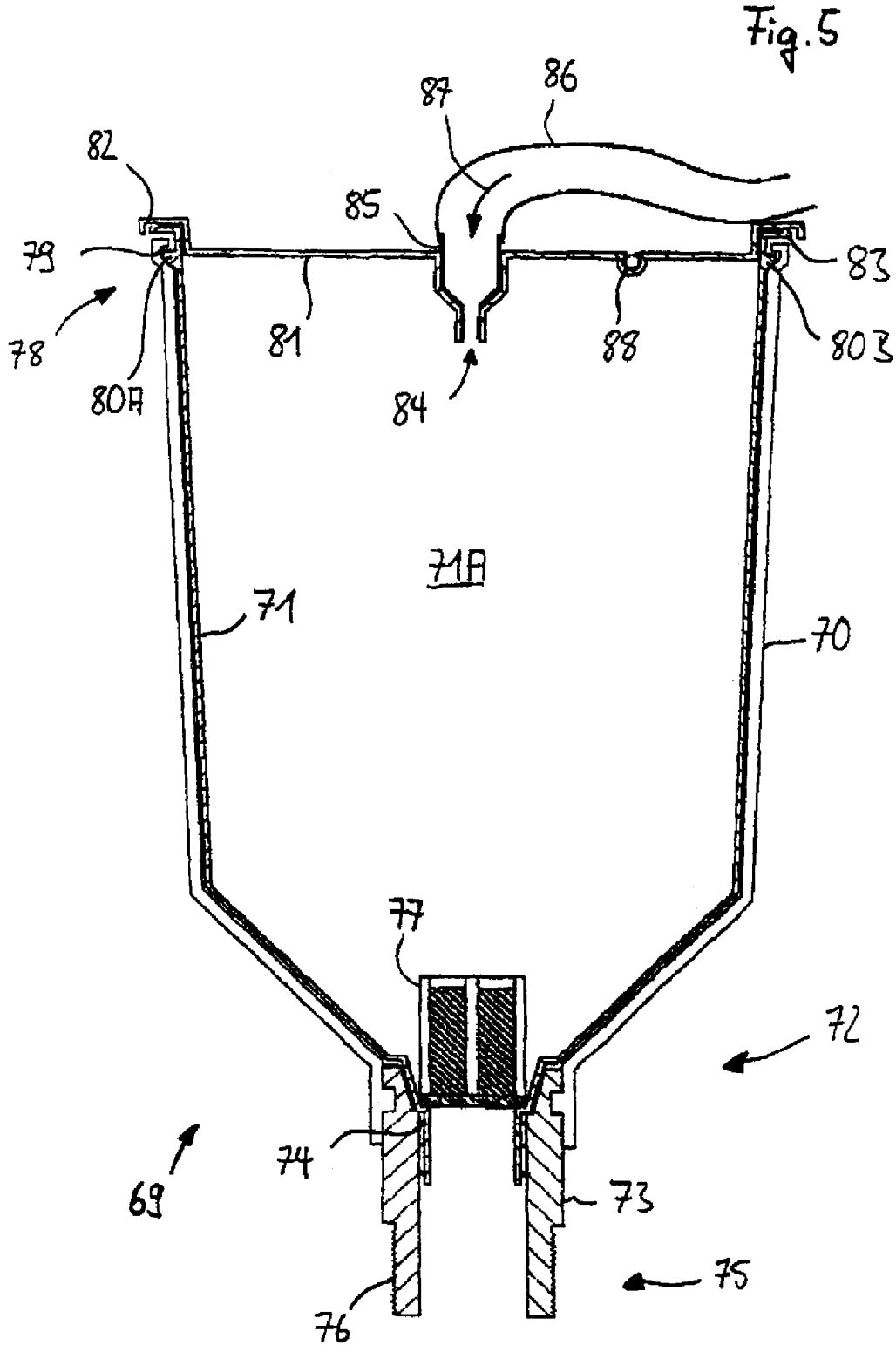

The spray gun container 69 shown in FIG. 5 has essentially the same parts as the spray gun containers 1, 23 and 36 discussed above. Here again, the spray gun container 69 comprises a container part 70 and a container insert 71, whereby the container insert 71 is already arranged in the container part 70.

First, the container part 70 and the container insert 71 are joined to together in an area 72, which faces a spray gun 26 (see FIG. 2) by means of an adapter 73. The container part 70 is connected here to a known bayonet closure (27A, FIG. 2). Container insert 70 however, is connected to the adapter 73 by means of three ring gaskets 74 (assigned a number here only as an example).

Again in this exemplary embodiment, the adapter 73 has a fine thread 76 with which it can be mounted on a spray gun (26, see FIG. 2).

In addition, a screen 77 with which container insert contents can be filtered before flowing into a spray gun (26, see FIG. 2) is provided in the container insert 71.

On the end 78 of the container part 70 opposite the adapter 73, the container part 70 has an at least partially peripheral grooves 79 in which fastening straps 80A and 80B of the container insert 71 are arranged at least in the installed state of the container insert 71. The peripheral grooves 79 may have a spiral pattern along the inside of the container part 70.

Figure 10:
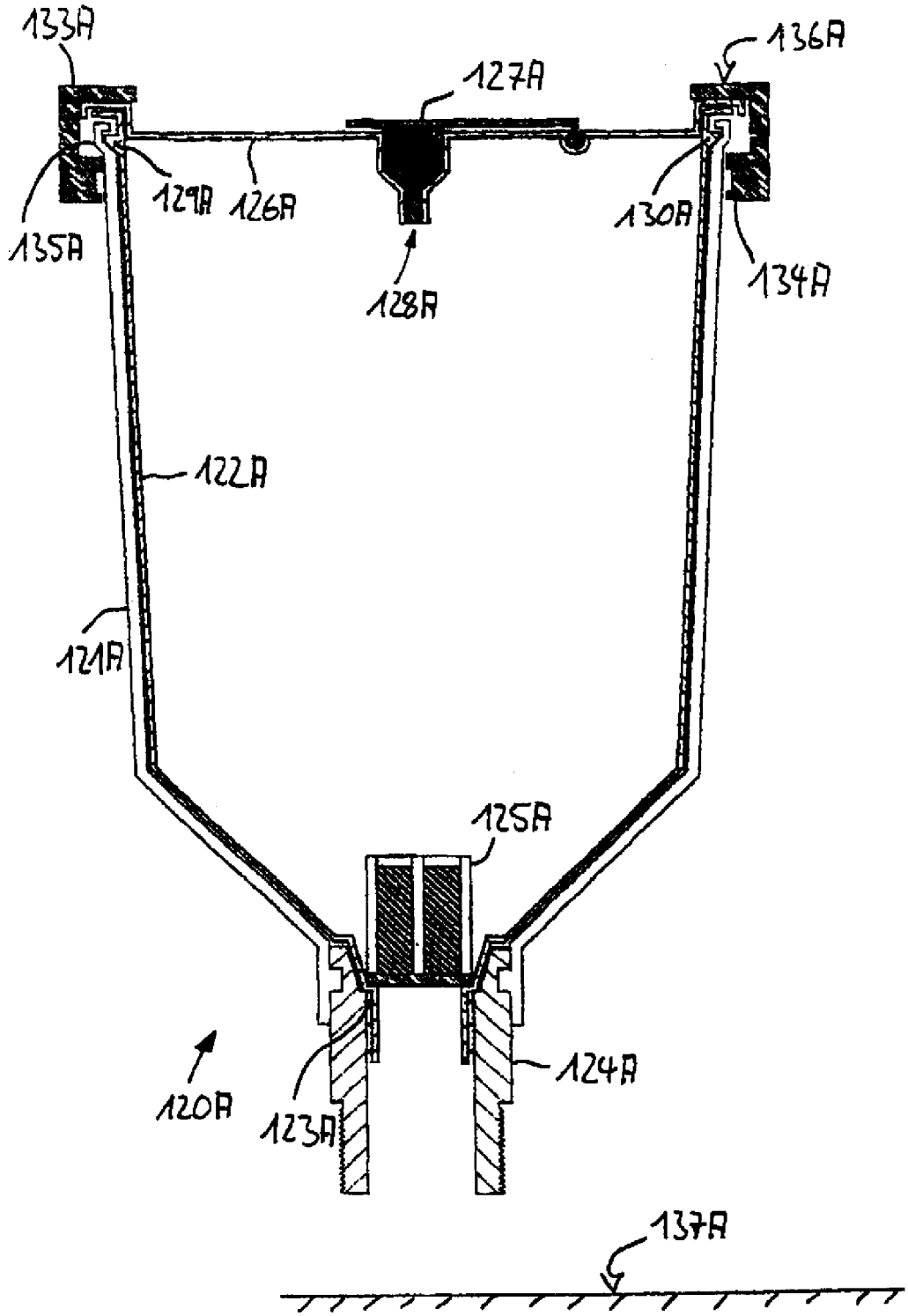

According to the grooves 79, the container part 70 has a peripheral elevation on its outside on which may be provided a coupling ring 133A as needed (see FIG. 10).

In addition to the loose connection by way of the sealing rings 74, the container insert 71 is additionally fixedly but detachably connected to the container part 70 by means of this form-fitting connection.

In the upper area 78 the spray gun container 69, in particular the container insert 71 is sealed by a cover 81. The cover 81 has a peripheral groove 82 on its outer area, which accommodates an upper peripheral edge 83 of the container insert 71, preferably in a form-fitting manner. The cover 81 is thereby secured on the spray gun container 69.

In addition, the cover 81 has a central opening 84 through which spray gun container contents can be poured into the container insert 71. The opening 84 has a receptacle 85 on the side facing away from the container insert 71. The receptacle 85 is suitable for accommodating a tubing 86 so that the tubing 86 is loosely connected to the spray gun container 69.

Air is supplied through the tubing 86 to the container insert 71 in the direction of arrow 87 so that a slight excess pressure results inside of the container insert 71 and the spray gun container 69 is thus suitable for use in a low-pressure spraying process.

Figure 6:
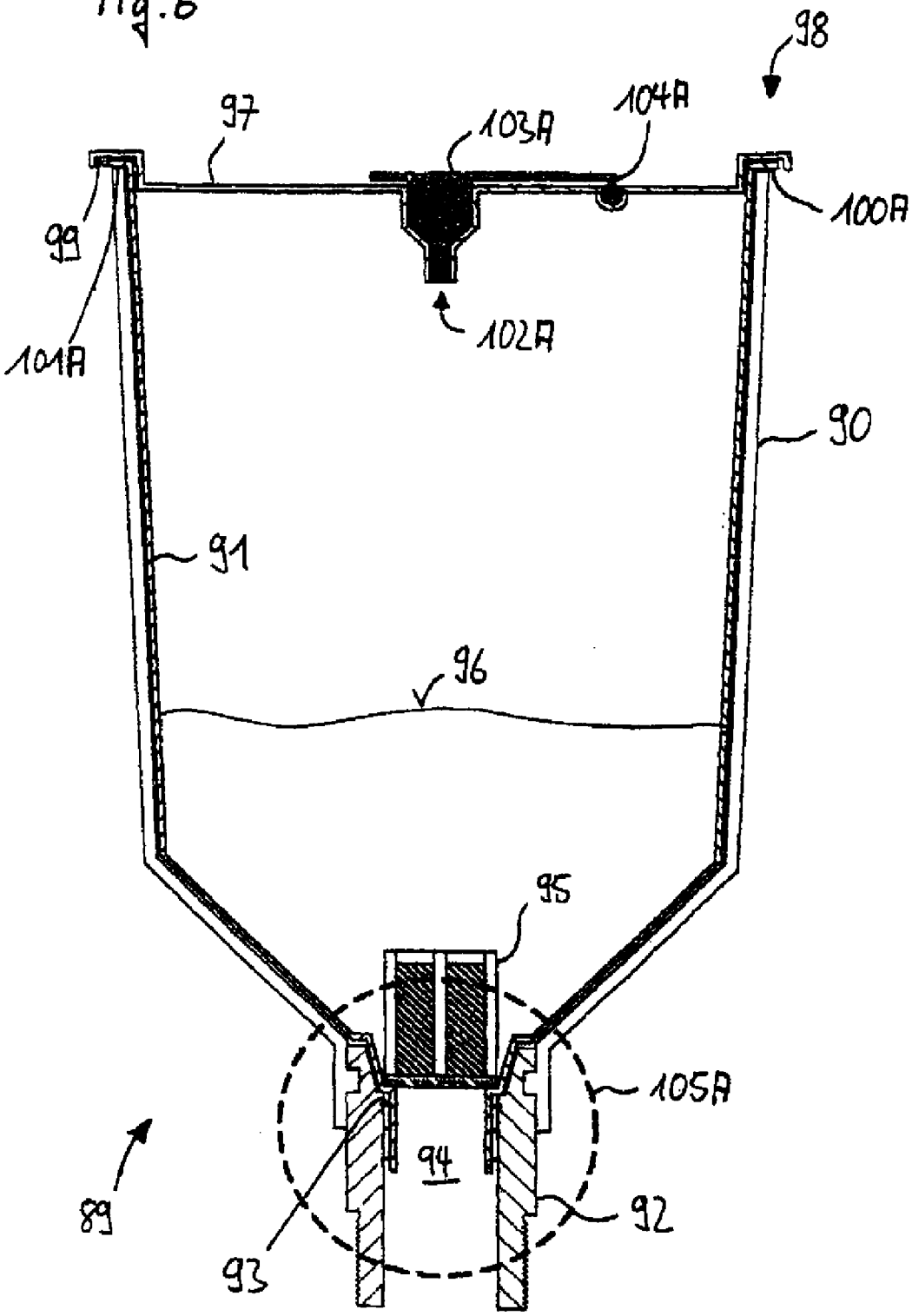

In addition, the cover 81 has an at least hemispherical recess 88 in which may be arranged a receptacle of a stopper 103A corresponding to the inside contour of the recess (see FIG. 6). By means of the stopper 103A, the opening 84 of the cover 81 can be closed as needed so that the interior 71A of the container insert 71 is also sealed completely in the area of the cover 81.

The exemplary embodiment according to FIG. 6 shows a spray gun container 89 which, as already explained repeatedly, consists essentially of a container part 90 and a container insert 91. Again in this exemplary embodiment, the container part 90 is connected to the container insert 91 by an adapter 92. To do so, the container part 90 has a form-fitting connection with respect to the adapter 92 as already described in FIG. 5. The container insert 91, however, as already described in FIG. 5, has only a loose connection by way of sealing rings 93 (assigned a number here only as an example) to the adapter 92. A screen 95 which filters the container insert contents 96 before reaching a spray gun 59 (FIG. 4) is also provided on an opening 94 here.

Again in this exemplary embodiment, the spray gun container 89 is sealed by a cover 97. To do so, the cover 97 includes a peripheral groove 99 in its edge area 98. If the cover 97 is placed on the spray gun container 89, in particular on the container insert 91, a peripheral edge 100A of the container insert 91 sits in the peripheral groove 99 of the cover 97.

With the same peripheral edge 100A, the container insert 91 rests on the upper edge 101A of the container part. Therefore the container insert 91 is further secured with respect to the container part 90.

In contrast with the container parts 2 and/or 70 already described, container part 90 in this exemplary embodiment has neither an outside thread 19 (see FIG. 1) nor a groove 79 (see FIG. 5). The container part 90 is instead cylindrical in design in the area of the cover 97 without any other structure.

The cover 97 also includes an opening 102A in which a stopper 103A is arranged. In order for the stopper 103A to also remain arranged on the cover 97 when the stopper 103A does not seal the opening 102A, the stopper 103A also has a form-fitting connection 104A with respect to the cover 97. Thus the stopper 103A remains situated on the cover 97 even when the stopper 103A is not in the opening 102A.

The area 105A shown inside the circle schematically in FIG. 6 is shown on an enlarged scale in FIG. 7. Essentially here (FIG. 7) the form-fitting connection between the container part 90 and the adapter 92 and the loose connection between the container insert 91 and the adapter 92 are shown in detail.

To implement the form-fitting connection between the container part 90 and the adapter 92, the adapter has a groove 107A in its upper area 106A, corresponding to a type of spring 108A of container part 90 and thereby forming the form-fitting connection between these two parts 90 and 92.

A peripheral groove 110A is also arranged on a cylindrical inside 109A of the adapter 92. With the container insert 91 in place, a sealing ring 93 arranged on it is at least partially accommodated in this peripheral groove 110A so that at least one sealing 93 of the container insert 91 is secured in a peripheral groove 110A of the adapter 92.

The other sealing rings 93A and 93B, however, do not engage in a peripheral groove 110A of the adapter 92 but they also have a stabilizing effect so that the container insert 91 is supported on the cylindrical inside wall 109A of the adapter 92 in at least three areas spaced a distance apart from one another.

Within the container insert 91 the screen 95 is detachably secured on the peripheral area 111A of the container insert 91 in a friction-locked manner.

FIG. 8 illustrates a conically tapered container insert 112A, which has two opposing fastening straps 114A and 115A on its upper edge 113A. The fastening straps 114A and 115A correspond to an at least partially peripheral groove 79 (see FIG. 5) of the container part 70 when the container insert 112A is inserted On the side of the container insert 112A opposite the upper edge 113A there is an opening 116 through which the container insert contents 96 (see FIG. 6) enter a spray gun 59 (see FIG. 4). The areas 117A, 118A and 119A show additional internal surfaces of the container insert 112A which taper conically in stages from the upper edge 113A to the opening 160A, resulting in gradually tapering cylindrical cross section of the container insert 112A from top to bottom, i.e., running into the plane of the paper.

Figure 9:
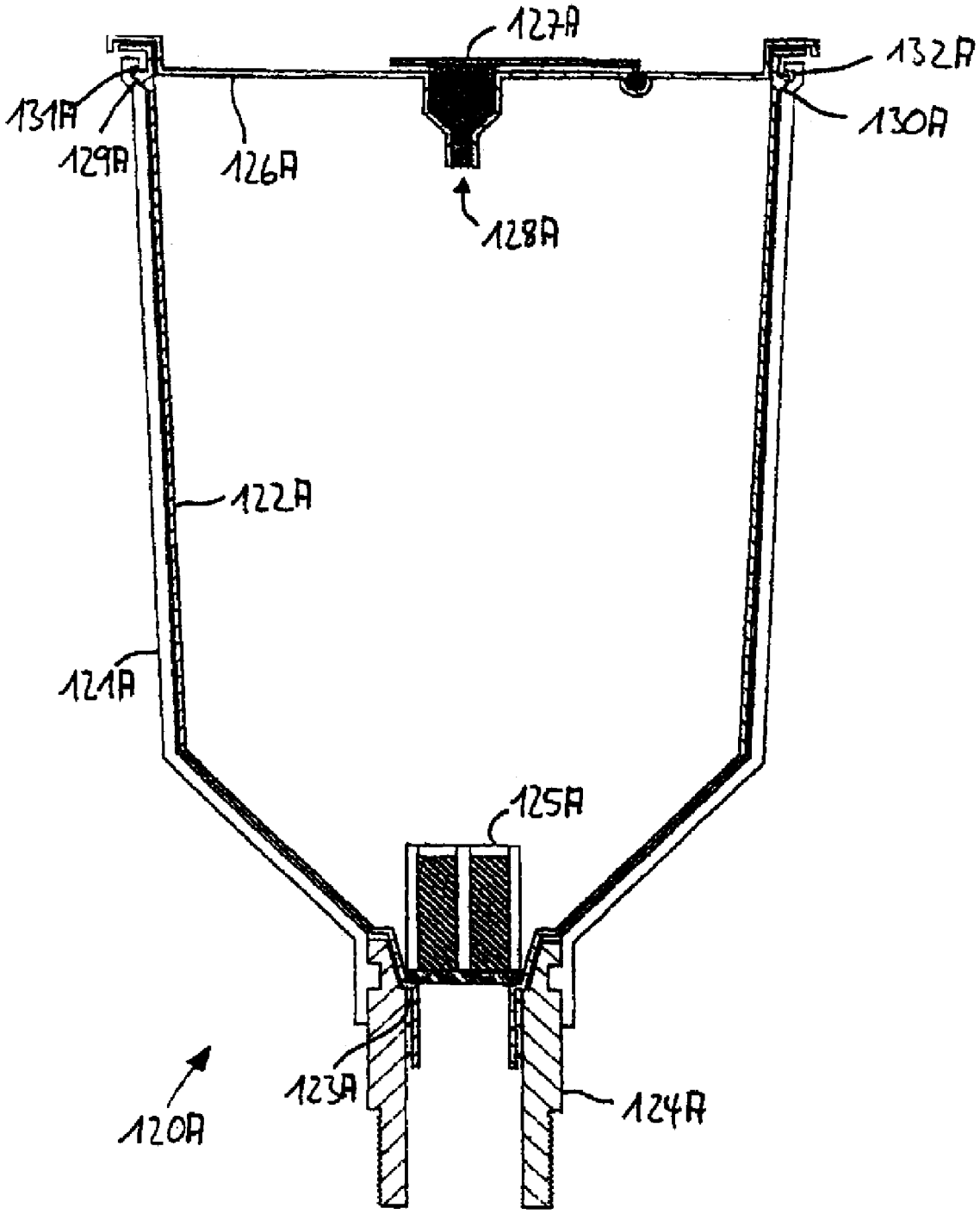

FIGS. 9 and 10 each show a spray gun container 120A, which has essentially the same design as the spray gun container 69 of FIG. 5. The spray gun container 120A also includes a container part 121A in which is arranged a container insert 122A. The two parts 121A and 122A are here again joined together by means of an adapter 124A with a ring gasket 123A. The spray gun container 120 also has a screen 125A and a cover 126A. A stopper 127A, which seals an opening 128A of the cover 126A, is arranged on the cover 126A. The container insert 122A also has two fastening straps 129A and 130A, each engaging in a groove 131A and 132A in the installed state.

In addition, FIG. 10 shows a coupling ring 133A which is arranged in the cover area of the spray gun container 120A and secures first the cover with respect to the container insert 122A and secondly the container insert 122A with respect to the container part 121A. To do so, a part 134A of the coupling ring 133A engages behind a projecting edge 135A of the container part 121A such that the coupling ring 133A is arranged in a form-fitting manner on the spray gun container 120A.

The coupling ring 133A here is made of an elastic material so that the area 134A can be pulled over the edge 135A of the container part 121A when the coupling ring 133A is placed in position and then it can snap behind the edge 135A.

It is self-evident that in another exemplary embodiment, the coupling ring 133A can also be screwed onto the container part 121A.

In addition, the coupling ring 133A has a relatively flat surface 136A on which the entire spray gun container 120A is placed on a substrate 137A and can optionally be stored for a long period of time. It is self-evident that the covers 97 (see FIG. 6) and 126A may have a tubing 86 (see FIG. 5) so that the spray gun containers 89 and 120A shown in FIGS. 6 and 9, respectively are also suitable at the same time for a low-pressure spraying process. To do so, the tubing 86 may be inserted into the opening 102A or 128A, or the openings 102A and 128A may be prepared in such a way that they have a collar on which the tubing 86 can be arranged, as is the case with the receptacle 85 (see FIG. 5).

Figure 11:
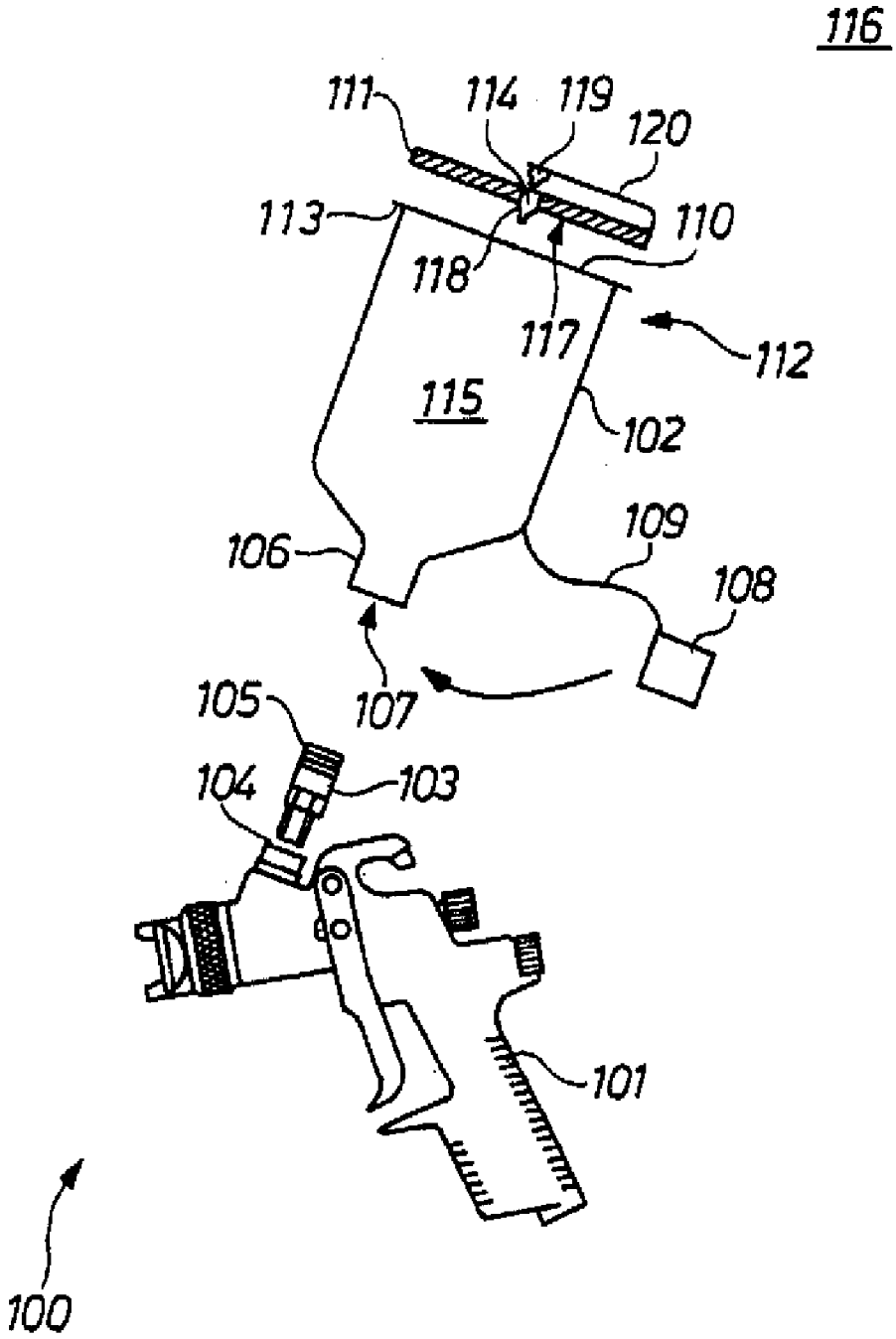

FIG. 11 shows an arrangement 100 with a spray gun 101 and a single-walled spray gun container 102, the two parts 101 and 102 being joined together by means of an adapter 103. To do so, the adapter 103 is screwed onto a receptacle 104 of the spray gun 101.

The adapter 103 also has a receptacle 105 onto which the single-walled spray gun container 102 is clipped with its side 106 facing the spray gun 101 on the spray gun container receptacle 105 of the adapter 103.

If the single-walled spray gun container 102 is not situated on the spray gun container receptacle 105 of the adapter 103 or on the receptacle 104 of the spray gun 101, then a small first opening 107 of the single-walled spray gun container which is on the side 106 facing the spray gun 101 can be closed completely by means of a small first cover 108. To do so, the small first cover 108 is inverted at least partially over the side 106 facing the spray gun 101. The small first cover 108 is attached by means of a strap 109 to the single-walled spray gun container 102 as a type of "loss-proof device." The strap 109 is directly molded on the first small cover 108 as well as on the single-walled spray gun container 102.

Since the single-walled spray gun container 102 also has a large opening 110, the single-walled spray gun container 102 has a large second cover 111 accordingly. The large opening 110 is situated on a side 112 facing away from the spray gun 101.

The large second cover 111 is simply clipped onto an upper edge 113 of the single-walled spray gun container 102 in this exemplary embodiment.

The large second cover 111 has a closable passage 114 in its center through which a pressure equalization is established during a painting process between the interior 115 of the spray gun container and the environment 116. The interior 115 of the spray gun container is a paint holding area of the spray gun container 102, which holds a supply of paint inside the spray gun container 102.

In addition, the closable passage 114 has a collar 118 having a shape that tapers in a conical form on its side 117 facing the interior 115 of the spray gun container.

To be able to close the reclosable passage 114 so that paint 239 (see FIG. 12) does not enter the environment 116 through the passage 114 out of the interior 115 of the spray gun container, the large second cover 111 therefore has a stopper 119.

The stopper 119 is also conical in shape so that the stopper 119 is adapted to the conical shape of the closable passage 114 and therefore can be arranged quite well in the closable passage 114.

In order to prevent the stopper 119 from being lost unintentionally, the stopper 119 is attached to the cover 111 by means of a stopper holder 120. The stopper holder 120 is directly molded on both the stopper 119 and on the large second cover 111 so that the large second cover 111, the stopper 119 and the stopper holder 120 are manufactured in an injection molding process.

Figure 12:
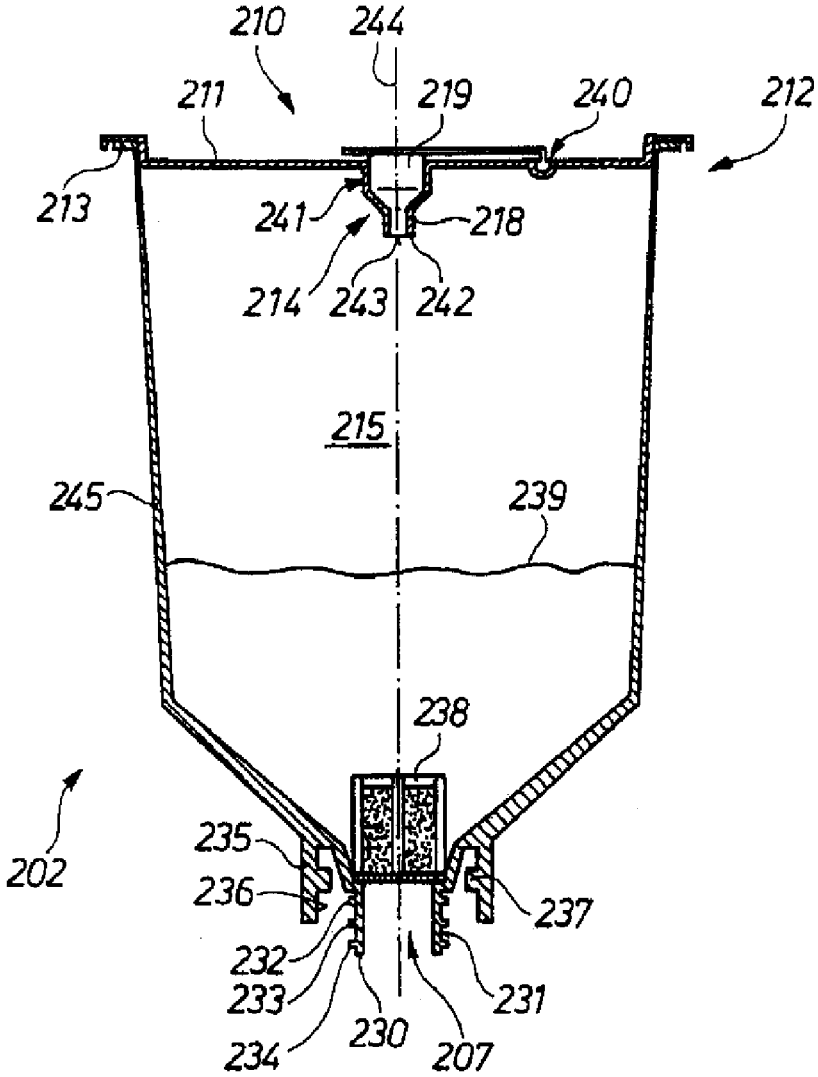

The single-walled spray gun container 202 shown in FIG. 12 has a catch-type connection 230 with a sealing ring 232, a first guide ring 233 and a second guide ring 234 being arranged on its lateral surface 231. The single-walled spray gun container 202 is mounted on a spray gun container receptacle 104 of a spray gun 101 (see FIG. 11) by means of this catch-type connection 230. The catch-type connection 230 of the single-walled spray gun container 202 is clamped with the receptacle 104 of the spray gun 101 (see FIG. 11) by means of the sealing ring 232 and the first guide ring 233 as well as the second guide ring 234 so that so that the single-walled spray gun container 202 is tightly connected to the spray gun 101.

To additionally secure this tight connection, the single-walled spray gun container 202 has a peripheral web 235 which is situated directly on the single-walled spray gun container 202 and forms a physical unit with the single-walled spray gun container 202. Therefore the peripheral web 235 and the single-walled spray gun container 220 are manufactured from a single casting.

In addition, the peripheral web 235 is in direct proximity around the catch-type connection 230 and has a peripheral spring 237 on its side 236 facing the catch-type connection 230, this spring being suitable for engaging in a corresponding groove (not shown here) of a spray gun 101 (see FIG. 11). To facilitate such engagement of the peripheral spring 237, the peripheral web 235 is made of an elastic material, namely the same elastic material of which the entire single-walled spray gun container 220 is manufactured in the present exemplary embodiment.

In the interior 215 of the single-walled spray gun container 202, a screen 238 is arranged in front of the catch-type connection 230, so that container contents 239 are filtered before leaving the single-walled spray gun container 202.

Figure 13:
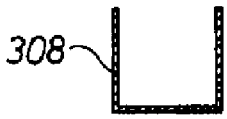

If the single-walled spray gun container 202 is not arranged on a spray gun receptacle 104, then the smaller opening 207 of the single-walled spray gun container 202 can be sealed by arranging a cover 308 (see FIG. 13) with a catch-type engagement on the catch-type connection 230.

A large, reclosable cover 211 is also arranged with a catch-type engagement on the edge 213 of the single-walled spray gun container 202 on the side 212 of the single-walled spray gun container 202 opposite the catch-type connection 230, so that the single-walled spray gun container 220 can also be sealed completely on the side 212. In order to allow air to flow into the interior 215 of the container when contents 239 are removed from the container, the reclosable cover 211 has a stopper 219 which closes a closable passage 214.

The closable passage 214 has a collar 218 which protrudes into the spray gun container interior 215 when the cover 211 is properly clipped in place. In the case in which the stopper 219 is pulled out of the closable passage 214, air flows through the opening, which has thereby become free, through the cover 211 and into the interior 215 of the spray gun container.

The stopper 219 in this exemplary embodiment is attached to the cover 211 in a recess 240.

The collar 218 of the closable passage 214 forms a depression 241 of the large cover 211 to which the collar 218 is connected with a conical taper. Therefore, the closable passage 214 has a large diameter in the area of the depression 241 and has a much smaller diameter in the area of the bottom side 242 of the collar 218. The stopper 219 is also shaped according to the shape of the closable passage 114.

This has the advantage, first of all, that the stopper 219 can be inserted easily and therefore especially rapidly into the large diameter of the depression 241, in which case the stopper 219 undergoes a type of pre-centering. Then the stopper 219 slides easily into the smaller diameter of the collar 218 because of the tapering collar 218, thereby closing the closable passage 214, which has a small diameter, mainly in the area of the bottom side 242 of the collar. On the basis of this, the stopper 219 can also come in contact with the contents 239 of the single-walled spray gun container 204 with only its smaller end face 243. Accordingly, this greatly reduces the risk of a large quantity of the contents 239 escaping from the interior 215 of the spray gun container when the stopper 219 is pulled out of the closable passage 214 and thereby soiling components (not shown here) outside of the single-walled spray gun container 202.

Instead, only a very small amount of contents 239 of the spray gun container can go from the interior 215 of the single-walled spray gun container 202, if any at all, when the closable passage 214 is opened because of the small area of the end face 243 of the stopper 219.

Since the single-walled spray gun container 202 is also designed as a disposable spray gun container, the single-walled spray gun container has a spray gun container wall 245 which becomes thicker along its longitudinal axis 244, beginning at its upper edge 213 in the direction of its peripheral web 235.

Due to the fact that the container wall 245 is thicker in the lower area of the spray gun container 202 than in the upper area, the single-walled spray gun container 202 has a stable design on the whole. Because of the fact that the single-walled spray gun container has a spray gun container wall 245 which is not as thick, however, in the area of a large opening 210, a substantial amount of material is saved in the manufacture of the single-walled spray gun container 202.

The single-walled spray gun container 402 illustrated in FIG. 14 corresponds essentially to the single-walled spray gun container 202 in FIG. 12. The single-walled spray gun container 402 also has a variable wall thickness 445 and has a reclosable cover 411 on its upper opening 410. The cover 411 is clipped like a catch on the edge 413 of the single-walled spray gun container 402. The cover 411 also has a reclosable passage 414 which is formed by a depression 441 and also by a collar 418 connected to the depression 441. The reclosable passage 414 is closed by a stopper 419. A screen 438 which is provided in the interior 415 of the single-walled spray gun container 402 is arranged on a small opening 407 of the single-walled spray gun container 402. A catch-type connection 430 and a peripheral web 435 having a peripheral spring 437 are provided on the side of the small opening 407.

In this exemplary embodiment, an adapter 403 is situated on the catch-type connection 430. The adapter 403 here is attached like a catch to the single-walled spray gun container 402 by a first guide ring 432 and a second guide ring 433 plus a sealing ring 434. In addition, the spring 437 of the peripheral web 435 snaps into a corresponding adapter groove 455, so the adapter 403 is additionally secured on the single-walled spray gun container 402.

The adapter 403 is screwed onto the receptacle 104 of a spray gun 101 (see FIG. 11) by means of a precision thread 456 on the adapter.

The small cover 508, which is screwed in according to FIG. 15, is pushed as needed over the precision thread 456 of the adapter 403 (see FIG. 14) so that this closes the small opening 407 of the single-walled spray gun container 402. The single-walled spray gun container 402 is completely closed by the small cover 508 and the large cover 411, so the contents 439 of the container are prevented from escaping from the interior 415 of the container.

Figure 16:
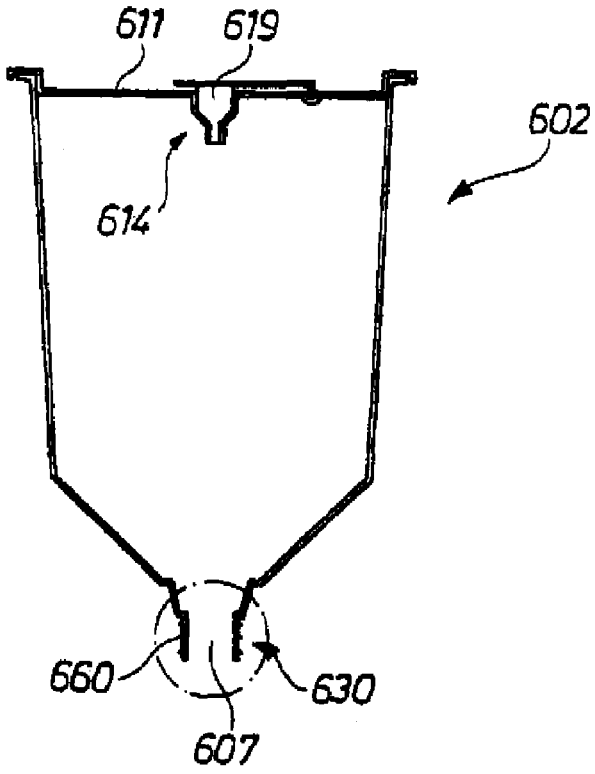
Figure 17:
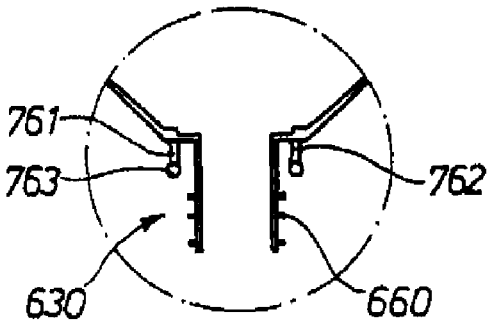
Figure 18:
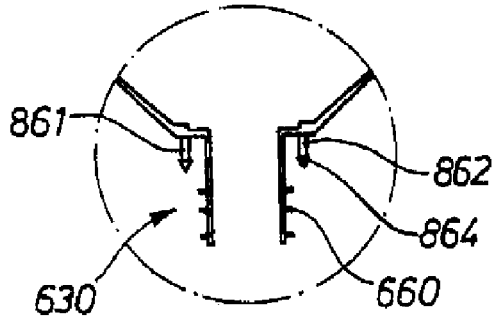
Figure 19:
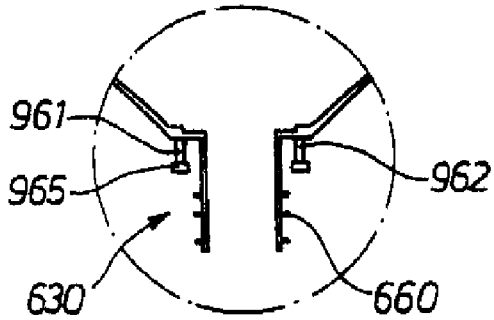

The single-walled spray gun container 602 in FIG. 16 also has a large cover 611 which is clamped on the single-walled spray gun container spray gun container 202. The large cover 611 has a closable passage 614 in which a stopper 619 is arranged, closing the closable passage 614.

In the area of its small opening 107, the single-walled spray gun container 602 has a catch-type connection 630 by which the single-walled spray gun container 602 can be situated on an adapter 403 (see FIG. 14) or on a receptacle 104 of a spray gun 101 (see FIG. 11).

In this exemplary embodiment, the catch-type connection 630 includes multiple catch means 660 (provided with a number here only as an example) which are provided in the form of a peripheral spring 237 (see FIG. 12) on the catch-type connection 630. These catch means 660 are sufficient to reliably attach the single-walled spray gun container 602 at a location provided for this purpose.

One exemplary embodiment in each of FIGS. 17 through 20 illustrates how the catch-type connection 630 can be secured by two additional webs in each case.

Figure 20:
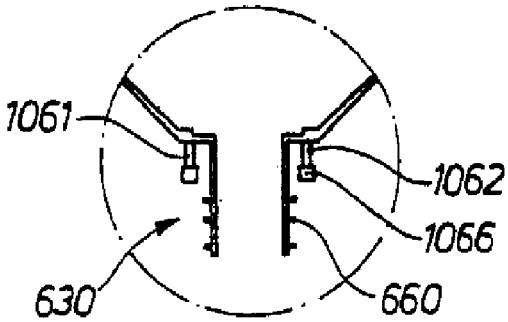

Accordingly, each of FIGS. 17 through 20 illustrates the catch-type connection 630 from FIG. 16 with a first web 761 in addition to the catch means 660 and with an additional second web 762 (see FIG. 17), with an additional first web 861 and with an additional second web 862 (see FIG. 18), a first web 961 and a second web 962 (see FIG. 19) and ultimately with a first web 1061 and a second web 1062 (see FIG. 20).

The two webs 761 and 762 here each have a spherical closure 763 (shown here with a number only as an example), the two webs 861 and 862 having a triangular closure 864 (shown with a number here only as an example), the two webs 961 and 962 each have a rectangular closure 965 (labeled with a number here only as an example) and the two webs 1061 and 1062 each have a square closure 1066 (shown with a number here only as an example).

Figure 22:
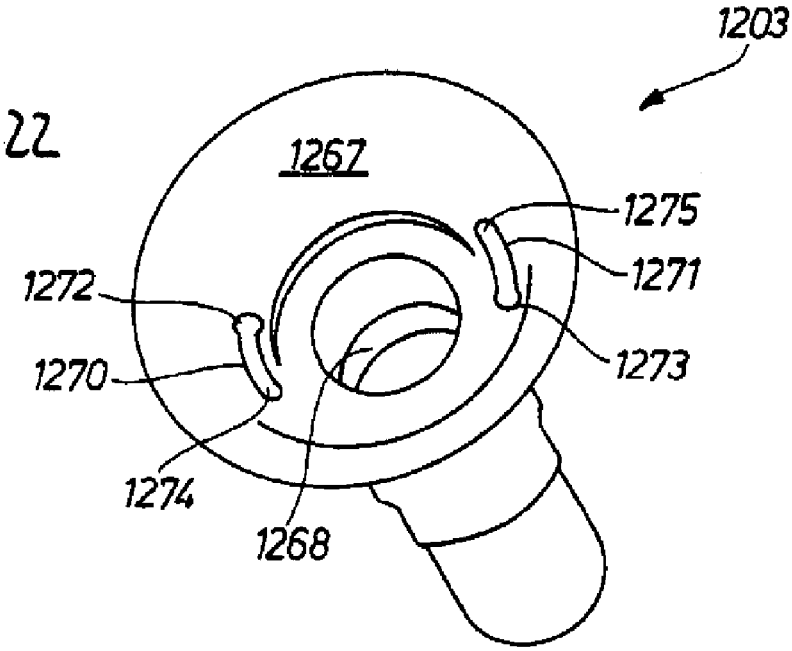

The additional webs 761, 762, 861 and 862, 961 and 962 as well as 1061 and 1062 illustrated in FIGS. 17 through 20 are not arranged peripherally around the connection 630 and correspond, for example, to a web receptacle 1270 and 1271 of an adapter 1203 (see FIG. 22).

Figure 21:
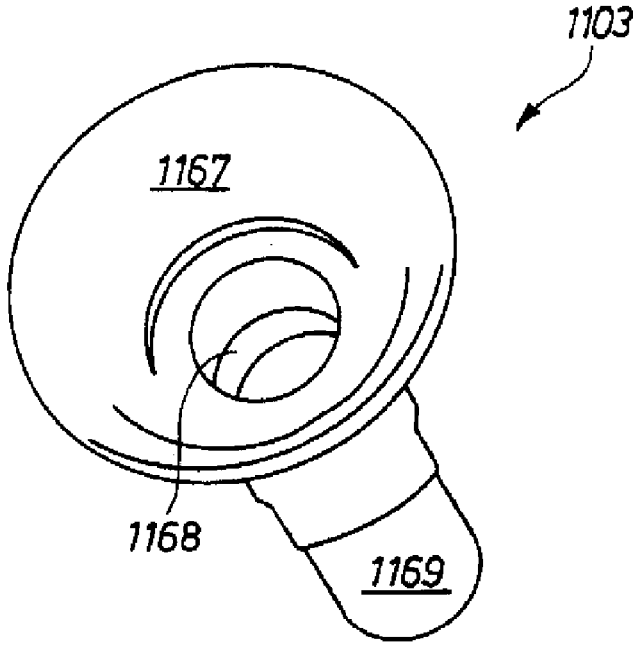

FIG. 21 illustrates an adapter 1103 in the shell-shaped area 1167 of which the spray gun container 602 (see FIG. 11) can be arranged, for example. The catch means 660 here (see FIG. 16) of the single-walled spray gun container 602 each correspond to an adapter groove 1168 so that the single-walled spray gun container 602 is arranged fixedly but detachably on the adapter 1103. The single-walled spray gun container 602 is additionally held securely by the shell-shaped area 1167 of the adapter 1103 designed with a large area. For example, the adapter 1103 is attached to a spray gun 101 (see FIG. 1) with the adapter end 1169.

FIG. 22 also shows an adapter 1203 which also has a shell-shaped area 1267. In addition, the adapter 1203 has adapter grooves 1268 (shown here with numbers only as an example) in which corresponding catch means 660 (see FIG. 16) can engage.

In addition, the adapter 1203 has two web receptacles 1270 and 1271 in its shell-shaped area 1267, so that the first web 761 and second web 762 (see FIG. 17) can engage in these web receptacles, respectively. This yields a single-walled spray gun container 602 (see FIG. 16) which has an additional hold on the adapter 1203.

The web receptacles 1270 and 1271 each have a plug insertion area 1272 and 1273 into which the conical closures 763 of the two webs 761 and 762 in particular can be inserted.

If the two webs 761 and 762 are inserted into the web receptacles 1270 and 1271, the single-walled spray gun container 602 and the adapter 1203 are rotated in opposite directions so that the spherical closures 763 are moved into a holding area 1274 and 1275 of the web receptacles 1270 and 1271. Since the holding areas 1274 and 1275 are narrower than the diameter of the spherical closures 763 of the two webs 761 and 762, the single-walled spray gun container 602 cannot be removed from the adapter 1203 without a reverse turning motion.

It is self-evident that all the catch-type connections described above are just examples and that a catch-type connection can be implemented by way of a variety of different embodiments. Therefore, the exemplary embodiments described above are given only for the purpose of illustration of the present inventive idea and are not to be understood as restrictive in any way.

In addition, it is also possible to provide spray gun containers on a shell-shaped or plate-shaped adapter 1103 (see FIG. 21) without a catch-type connection. It is thus possible to arrange a spray gun container 102 (see FIG. 11) also by means of a threaded connection on shell-shaped or plate-shaped adapters 1103. For example, the plate-shaped adapter may also be arranged on the spray gun container by means of a coupling ring.

In this context it should be pointed out that such adapters 1103 not only border on additional shell-shaped and/or plate-shaped holding areas 1167, 1267, but also in other variants, such adapters 1103 may also have additional differently designed spray gun container holding areas having collars on which a single-walled spray gun container 102 is advantageously supported and/or resting.

In addition, it is also possible for such supporting and/or holding and collar-forming holding areas 1167, 1267 to be provided not only by an adapter 1103 but also for such additional spray gun container holding areas 1167, 1267 to be arranged directly on a spray gun 101 (see FIG. 11). In such a case, the spray gun 101 has such a shell-shaped and/or plate-shaped area 1167 or 1267 directly in an area of the traditional receptacle 104 on which the single-walled spray gun container 102 is situated. The single-walled spray gun container 102 here is situated directly on the spray gun, with the single-walled spray gun container 102 additionally being supported and/or resting on the shell-shaped and/or plate-shaped area 1167. It is self-evident that such a holding 1167 or 1267 on the spray gun 101 may also be implemented in another design. For example, a holding area 1167 or 1267 having a similar effect may have only holding arms by means of which the single-walled spray gun container 102 gains additional hold on the spray gun 101.

On the basis of the fact that a spray gun container 102 gains additional holding security on a spray gun 101 having the additional holding areas 1167, 1267 described above, the features regarding a spray gun 101 with holding areas 1167, 1267 shaped in this way or similarly are also advantageous independently of the other features of the present invention.

Therefore, the spray gun 101 has not only a first holding area for a spray gun container 102 but also another additional holding area 1167, 1267 for the spray gun container 102, so that arrangement of a spray gun container 102 on a spray gun 101 is greatly simplified and therefore can also be performed more reliably.

To be able to arrange a spray gun container, in particular a single-walled spray gun container 102 on a receptacle 104 of a spray gun 101 by means of an adapter 103 (see FIG. 11) especially easily, it is advantageous if a connection 230 of the single-walled spray gun container 102 has a locking mechanism. The locking mechanism ensures that the single-walled spray gun container 102 is arranged preferably undetachably on an adapter 103. This has the advantage that the spray gun container 102 is intimately connected to the adapter 103 in such a way that the two components that are joined together form a compact unit and the adapter 103 can be mounted on the spray gun 101 with no problem and/or released from it again without the single-walled spray gun container 102 being released from the adapter 103.

This is particularly advantageous when, for the connection of these individual components, i.e., "single-walled spray gun container 102, adapter 103 and spray gun 101," a rotating movement must be executed between the individual components in order to connect the particular component to a corresponding component. If the connection 230 of the single-walled spray gun container 102 has such a locking mechanism, there is no risk that the component unit comprising the "single-walled spray gun container 102 and adapter 103" will also become detached when loosening the adapter 103 from the spray gun 102. Thus, the locking mechanism prevents the connection between the spray gun container 102 and the adapter 103 from being unintentionally released in releasing the adapter 103 from the spray gun 101. For example, the present locking mechanism operates according to the principle of a cable binder fastener, so that undetachable arrangement of a first component on another component can be implemented in a particularly simple structural manner.

An undetachable locking mechanism which establishes an undetachable connection between the single-walled spray gun container 102 and the adapter 103 is advantageous in particular when the components used are disposable components which are disposed of after use. In this way the locking mechanism can be manufactured in a particularly simple manner and accordingly can also be implemented inexpensively.

If the single-walled spray gun container 102 and the adapter 103 are not disposable components, but instead are to be reused many times, then it is advantageous if the locking mechanism additionally has an unlocking means. There is the possibility here that through operation of the unlocking means, the single-walled spray gun container 102 might become detached from the adapter 103 despite the presence of the locking mechanism. However, if the unlocking means of the locking mechanism is not operated, the single-walled spray gun container 102 cannot be detached from the adapter 103, so the component unit consisting of the "single-walled spray gun container 102 and adapter 103" can remain intimately connected when being attached to a spray gun 101 and in particular when being detached from a spray gun 101. Thus, despite an adapter 103 inserted in between the single-walled spray gun container and the spray gun 101, the single-walled spray gun container 102 can be arranged especially easily on the spray gun 101.

Figure 23:
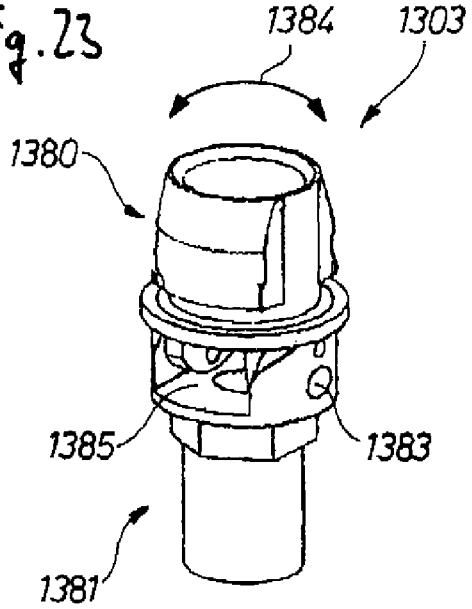

The adapter 1303 shown in FIG. 23 has a first holding area 1380 for holding a single-walled spray gun container 102 (see FIG. 11), for example, and also has a second holding area 1381 for receiving a spray gun 101 (see FIG. 11 for example). The two holding areas 1380 and 1381 are joined together in an articulated connection by an axis of rotation 383. This makes is possible for the first holding area 1380 to be pivoted about the axis of rotation 1380 according to the double arrow 1384 and thus also to be pivoted about the second holding area 1381. It is self-evident that the second holding area 1381 is accordingly also pivotable about the axis of rotation 1383 and consequently also about the first holding area 1380.

A single-walled spray gun container 102 can therefore advantageously be arranged on the first holding area 1380 of the adapter 1303 much more easily because the first holding area 1380 can be aligned with respect to the single-walled spray gun container 102 that is to be attached, and this can be accomplished virtually independently of the position of the spray gun 101.

The first holding area 1380 is attached to the single-walled spray gun container 102 in the manner of a bayonet closure in this exemplary embodiment. This permits particularly rapid attachment and removal of the single-walled spray gun container 102 from the first holding area 1380 of the adapter 1303.

In addition, the second holding area 1381 has a thread (not depicted explicitly here) by which the adapter 1303 can be screwed onto a commercial spray gun 101.

In the area of an interface 1385 between the first holding area 1380 and the second holding area 1381, the adapter 1303 is machined in such a way that paint goes smoothly without any problem from the single-walled spray gun container 102 through the articulated adapter 303 and into the spray gun 101.

Figure 24:
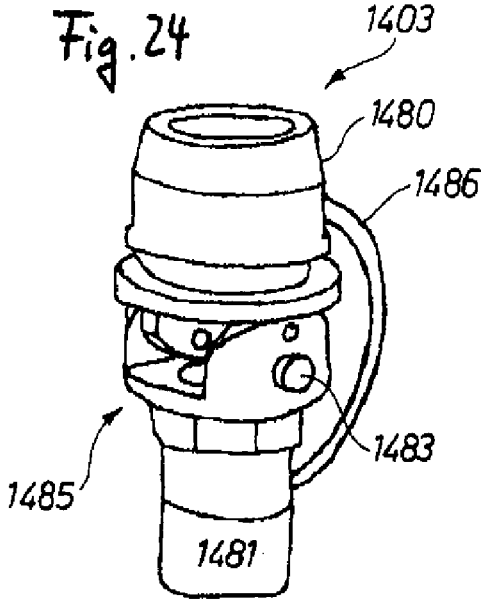

FIG. 24 illustrates another articulated adapter 1403. This articulated adapter 1403 also a first holding area 1480 and a second holding area 1481 which are joined together in an articulated joint by means of a suitable axis of rotation 1483.

The articulated adapter 1403 has an additional paint line 1486 by which a paint goes from the first holding area 1480 to the second holding area 1481. In this exemplary embodiment, the additional paint line 1486 is outside the articulated adapter 1403.

Due to the additional paint line 1486, the interface 1485 between the first holding area 1480 and the second holding area 1481 need not be machined with low tolerances in an expensive procedure, so the articulated adapter 1403 can be manufactured less expensively on the whole than the articulated adapter 1303.

Figure 25:
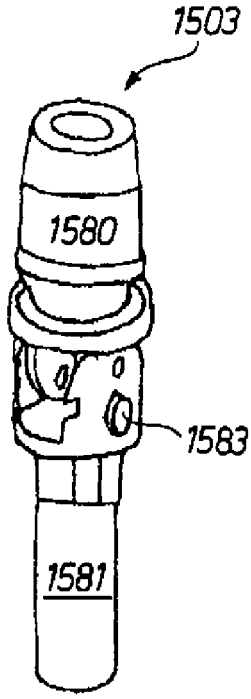

FIG. 25 illustrates another articulated adapter 1503 which has a narrower but higher first holding area 1580 and also has a narrower but higher second holding area 1581 than the two articulated adapters 1303 and 1403 discussed above.

The two holding areas 1580 and 1581 are also joined together by an articulated joint via a pivot 1583 so that the first holding area 1580 and the second holding area 1581 can be pivoted toward one another, thereby achieving the advantages mentioned above.

Figure 26:
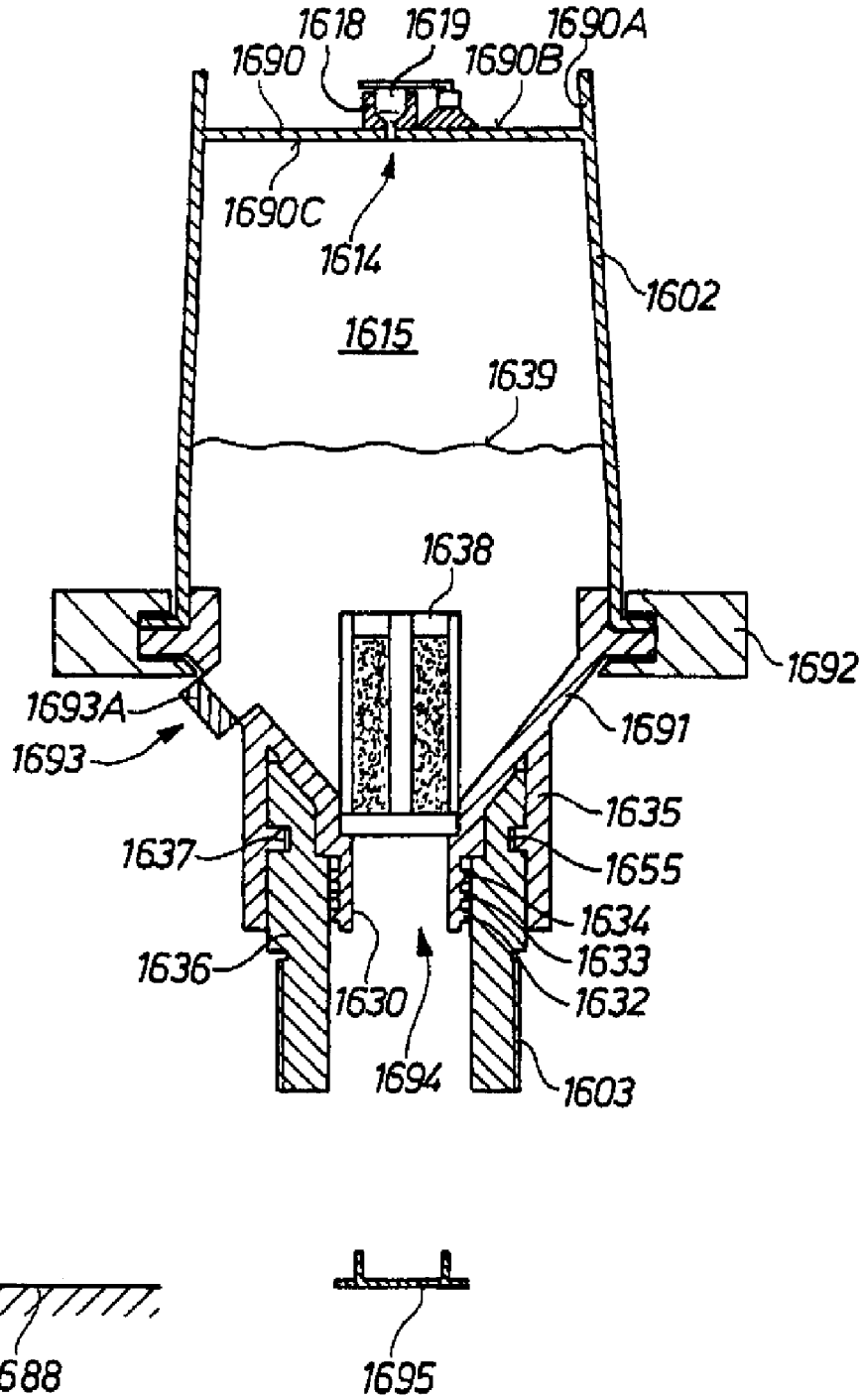

The single-walled spray gun container 1602 illustrated in FIG. 26 has a bottom 1690 in which a closable passage 1614 is provided. The closable passage 1614 provides additional access to the interior 1615, i.e., the paint holding area of the spray gun container 1602 in the sense of the present invention. The bottom 1690 is bordered by a peripheral bottom collar 1690A which is designed so that a collar 1680 of the closable passage 1614 can be arranged with no problem on the outside 1690B of the bottom 1690. Thus the single-walled spray gun container 1602 can be placed with its peripheral container collar 1690A on a substrate 1688. A stopper 1619 with which the closable passage 1614 can be closed is provided on the outside 1690B of the bottom 1690. When the stopper 1619 is inserted, the closable passage 1614 is closed so that the inside 1690C of the bottom 1690 essentially forms a flat surface. To do so, the stopper 1619 is shaped so that it does not protrude above the inside 1690C of the bottom when the passage 1614 is closed nor is it recessed behind the inside 1690C of the bottom. The flat surface makes it possible to introduce a stirring mechanism for mixing a two-component paint into the single-walled spray gun container 1602 when the single-walled spray gun container 1602 is placed on the peripheral bottom collar 1690A so that the mixing of the two-component paint can be advantageously performed directly in the single-walled spray gun container 1602.

The feature whereby the stopper 1619 forms a flat surface when the passage 1614 forms a flat surface with the inside 1690C of the bottom is also advantageous independently of the other features of the present invention. This greatly simplifies the changing of paint colors because a paint 1639 can be used much more quickly when it is mixed directly in the single-walled spray gun container 1602.

A spray gun container cover 1691 is attached by means of a coupling ring 1692 to the end of the single-walled spray gun container 1602 opposite the container bottom 1690.

A peripheral web 1635 is directly molded on the spray gun container cover 1691 and the spray gun container cover 1690 can be secured with a catch-type engagement on a spray gun 101 (see FIG. 1) by means of this web. In the immediate vicinity of the peripheral web 1635 there is a catch-type connection 1630. In addition, the peripheral web 1635 has a peripheral spring 1637 on its side 1636 which faces the catch-type connection 1630, said spring serving to engage in a corresponding adapter groove 1655 in an adapter 1603. To facilitate such engagement of the peripheral spring 1637, the peripheral web 1635 is made of an elastic material.

To achieve additional security between the single-walled spray gun container 1691 and the adapter 1603 and to seal the two components with respect to one another, the catch-type connection 1630 has both a sealing ring 1632 and a first guide ring 1633 and a second guide ring 1634. It is self-evident that the present sealing ring 1632 may also assume a guidance function. Accordingly, the first and second guide rings 1633 and 1634 may also assume sealing functions.

In addition, a screen 1638 which filters a paint 1639 before it goes out of the interior 1615 of the single-walled spray gun container 1602 into a spray gun 101 (see FIG. 11) is also provided on the spray gun container cover 1691.

To also be able to perform a filling of the single-walled spray gun container 1602 even when the spray gun container cover 1691 has been screwed onto it, a reclosable refilling opening 1693 is provided on the spray gun container cover 1691 in addition to the main opening 1694. The reclosable refilling opening 1693 in this exemplary embodiment is closed with a screw-on cover 1693A. It is self-evident that other closure options may also be provided for closing the reclosable refilling opening 1693 in the sense of this invention.

Moreover, such a refilling opening 1693 may also be provided in the area of the single-walled spray gun container 1602.

The features with regard to the reclosable refilling opening 1693 are also advantageous even without the other features of this invention because filling of a single-walled spray gun container 1602 that has already been used can be performed more rapidly through the refilling opening 1693.

In another exemplary embodiment, it is also possible to attach the spray gun container cover 1691 to the single-walled spray gun container 1602 directly and without a coupling ring 1692. A plug-in connection, an inverted connection or a screw connection could be provided for this purpose.

To also close the mail opening 1694 of the spray gun container cover 1691, the spray gun container cover 1691 includes a closure cap 1695.

A paint 1639 is added to the single-walled spray gun container 1602 which is sealed by the spray gun container cover 1691 and by the stopper 1619.

Figure 27:
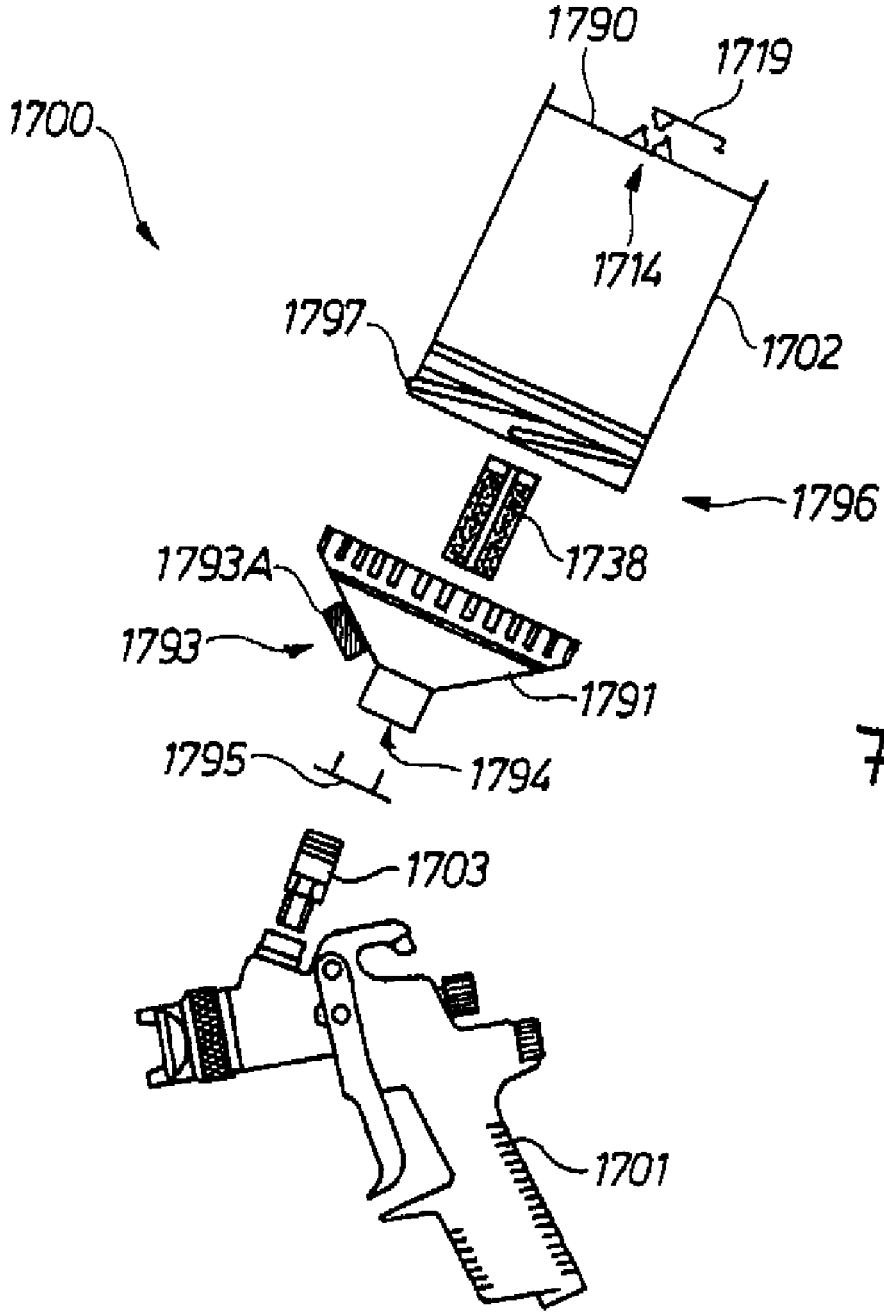

The arrangement 1700 shown in FIG. 27 includes essentially a spray gun 1701, a single-walled spray gun container 1702, a spray gun container cover 1791 and an adapter 1703. The single-walled spray gun container 1702 has a closable passage 1714 on the bottom 1791 of its container, said passage being sealed by a stopper 1719.

On the end 1796 opposite the spray gun container bottom 1790, the single-walled spray gun container 1702 has an outside thread 1797. The spray gun container cover 1791 is screwed onto the outside thread 1797, so that the single-walled spray gun container 1702 and the spray gun container cover 1791 form a tight but releasable unit.

On the inside of the spray gun container cover 1791 a screen 1738 is provided to filter the contents of the spray gun container before leaving the container, e.g., into the spray gun 1701.

The single-walled spray gun container 1791 has an additional reclosable refilling opening 1793 with a screw closure 1793A. The main opening 1794 of the spray gun container cover 1791 can be sealed as needed with a closure 1795. This is the case, for example, when a paint 1639 (see FIG. 26) is to be stored in the single-walled spray gun container 1702 which is sealed by the stopper 1719 and the spray gun container cover 1791.

To be able to attach the spray gun container cover 1791 with its main opening 1794 to any spray gun 1701, the adapter 1703 is provided between the spray gun container cover 1791 and the spray gun 1701.

Figure 28:
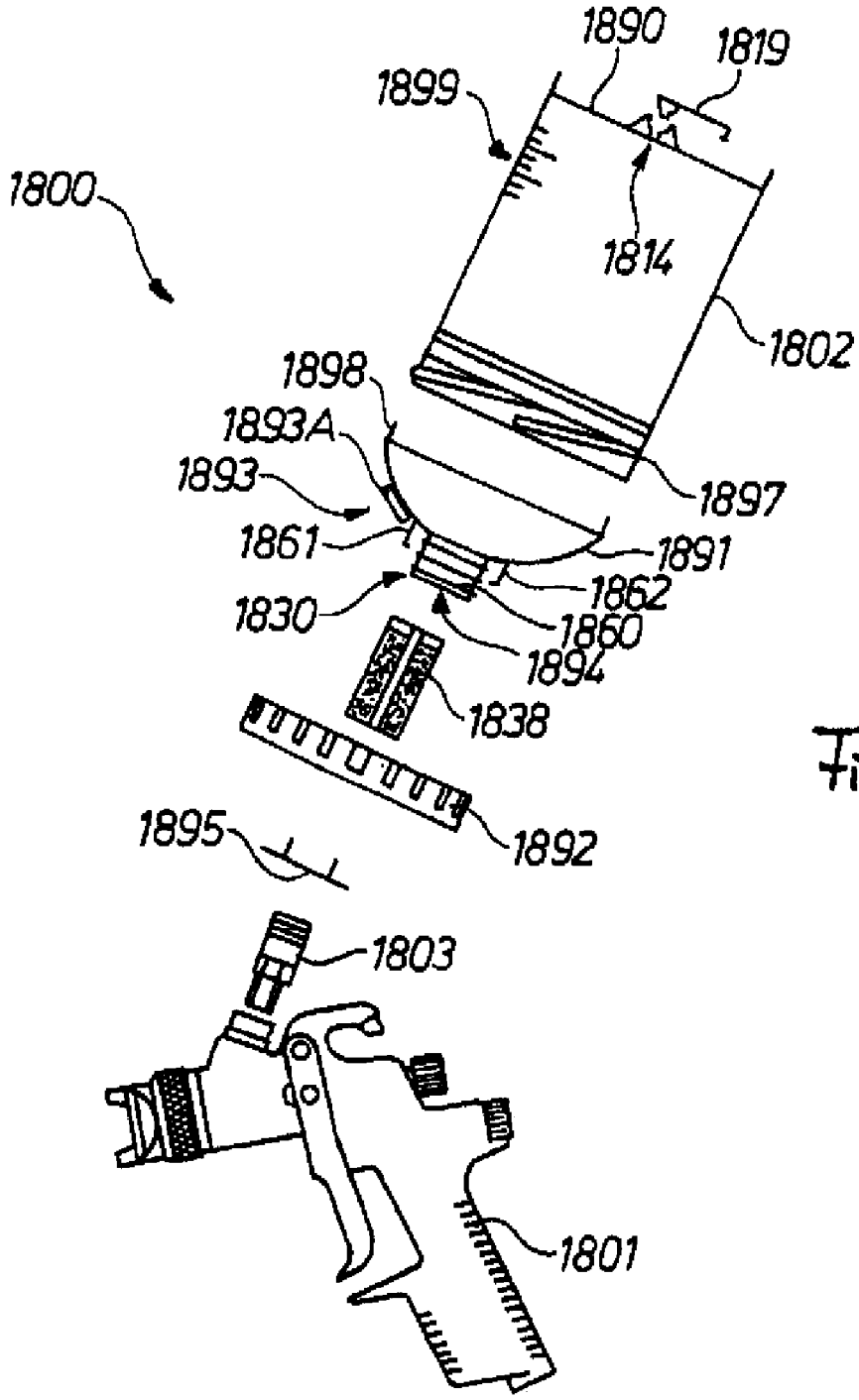
FIG. 28 another schematic diagram of an overall arrangement of a spray gun and a spray gun container having a cover which can be attached to the single-walled spray gun container by means of a coupling ring, FIG. 29 a schematic sectional side view of a single-walled spray gun container having a refilling opening provided on the container bottom, FIG. 30 another schematic diagram of a sectional side view of a single-walled spray gun container in which a refilling opening has a closable passage, FIG. 31 a schematic diagram of a releasable locking mechanism of a connection between a spray gun container and a cover and FIG. 32 a schematic diagram of an unreleasable locking mechanism of a connection between a spray gun container and a cover.

The arrangement 1800 illustrated in FIG. 28 comprises essentially a spray gun 1801, a single-walled spray gun container 1802 and an adapter 1803. The spray gun container 1802 includes a spray gun container cover 1891, which in this exemplary embodiment is attached to the single-walled spray gun container 1802 by a coupling ring 1892.

To be able to securely attach the coupling ring 1892 to the single-walled spray gun container 1802, the single-walled spray gun container 1802 has an outside thread 1897. The coupling ring 1892 has an inside thread corresponding to this (not shown here).

In the area of the spray gun container bottom 1890, the single-walled spray gun container 1802 has a closable passage 1814 which can be closed by means of a stopper 1819.

The spray gun container cover 1891 has, in addition to the main opening 194, a reclosable refilling opening 1893, which is closed by means of a screw cover 1893A. In addition, the spray gun container cover 1891 has a catch-type connection 1830 with catch means 1860. To arrange the spray gun container cover 1891 on the adapter 1803 in a manner that is particularly reliable in operation, the spray gun container cover 1891 additionally has a first web 1861 and a second web 1862. The additional webs 1861 and 1862 clamp the spray gun container cover 1891 onto the adapter 1803. To adjust the spray gun container cover 1891 in particular before screwing it on the single-walled spray gun container 1802, the spray gun container cover 1891 has an inside guide 1898 on the side facing the single-walled spray gun container 1802. The spray gun container cover 1891 can therefore be arranged on the single-walled spray gun container 1802 particularly rapidly and reliably. In this exemplary embodiment the inside guide 1898 is a peripheral ring.

In addition, a screen 1838 is arranged on the spray gun container cover 1891. This screen is inserted into the main opening 1894 of the spray gun container cover 1891 from the spray gun side.

To also be able to close the main opening 1894, the arrangement additionally includes a sealing cap 1895.

The single-walled spray gun container 1802 is made of a transparent material and has a scale 1899. The mixing of two-component paints in the single-walled spray gun container 1802 is greatly facilitated by means of the scale 1899 because metered addition of the individual components is greatly facilitated by the scale.

Figure 29:
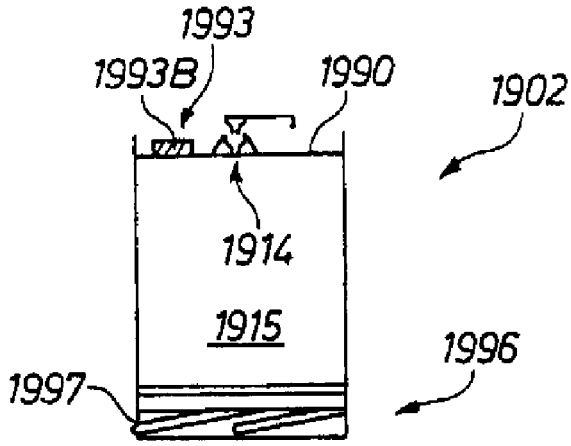

The single-walled spray gun container 1902 depicted in FIG. 29 has, in addition to a closable passage 1914, also a reclosable refilling opening 1993 in the area of its spray gun container bottom 1990. The reclosable refilling opening 1993 can be closed by means of a stopper 1993B.

The single-walled spray gun container 1902 has an outside thread 1997 on the side 1996 opposite the spray gun container bottom 1990 so that a spray gun container cover 1891 can be screwed onto this thread (see FIG. 28).

The reclosable refilling opening 1993 in the area of the container bottom 1990 next to the reclosable passage 1914 makes it possible to fill the single-walled spray gun container 1902. The closable passage 1914 here advantageously serves to allow air to escape from the interior 1915 of the spray gun container when resupplying a paint 1639 (see FIG. 26) through the closable passage 1914.

In this exemplary embodiment, a reclosable refilling opening 1893 (see FIG. 28) may be omitted with regard to the spray gun container cover 1891 because a corresponding refilling opening 1993 is provided on the container bottom 1990 of the single-walled spray gun container 1902.

Figure 30:
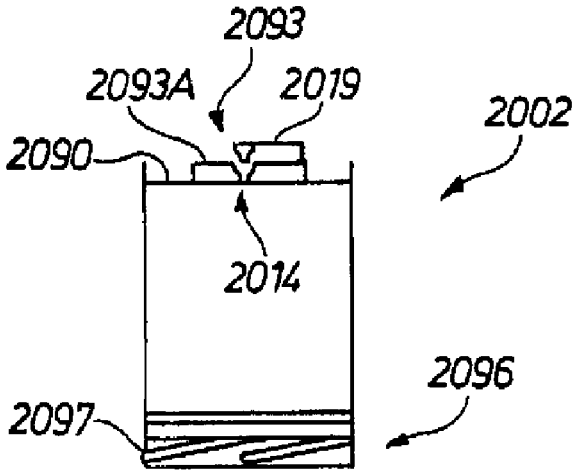

In contrast with the exemplary embodiment having a reclosable refilling opening 1993 arranged on the spray gun container bottom 1990 in addition to the closable passage 1914, a screw closure 2093A of a reclosable refilling opening 2093 may also have a closable passage 2014 (see FIG. 30). In this case the reclosable refilling opening 2093 and the closable passage 2014 are combined in one component. The closable passage 2014 in this exemplary embodiment is closed by means of a stopper 2019 as needed.

A closable passage 2014 directly in the bottom 2090 of the spray gun container may be omitted in this embodiment due to the reclosable passage 2014 on the screw closure 2093A of the reclosable refilling opening 2093. Thus, the two passages that were previously separate—the closable passage 1914 and the reclosable refilling opening 1893—are combined to form just one passage on the bottom 2090 of the spray gun container.

As explained for the single-walled spray gun containers described previously, the single-walled spray gun container 2002 has an outside thread 2097 on its side 2096 opposite the spray gun container bottom 2090 by which a spray gun container cover 1981 (see FIG. 28) can be arranged on the single-walled spray gun container 2002. It is advantageously possible here to omit the reclosable refilling opening 1893 (see FIG. 28) because a corresponding refilling opening 2093 is provided on the spray gun container bottom 2090 of the single-walled spray gun container 2002.

Figures 31, 32:
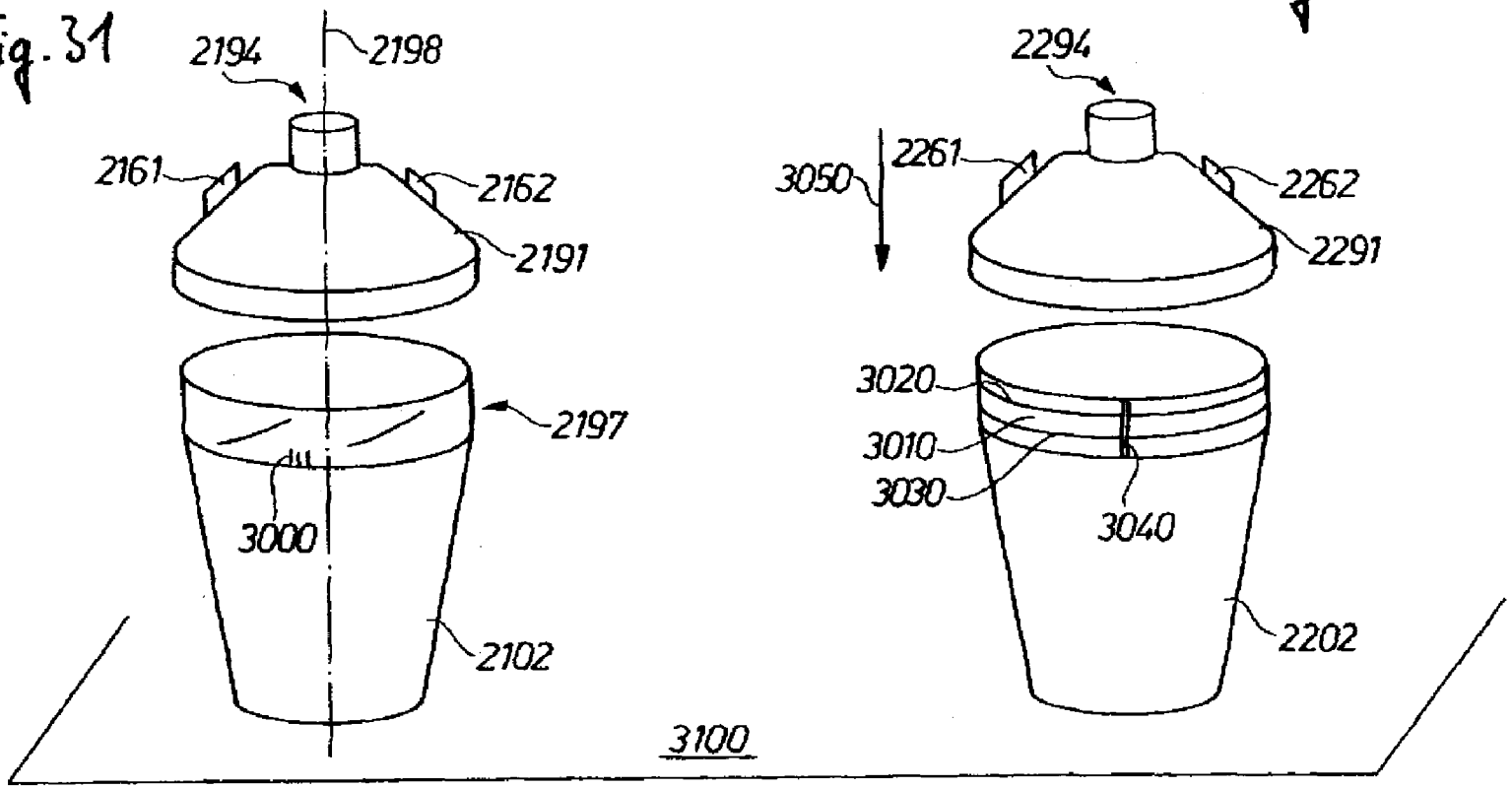

The single-walled spray gun container 2102 shown in FIG. 31 has a spray gun container cover 2191. The spray gun container cover 2191 has a main opening 2194 by which the spray gun container cover 2191 communicates directly either with a receptacle 104 of a spray gun 101 (see FIG. 11) or with an adapter 103 and/or a plate-shaped adapter 1203 (see FIG. 22). In the present exemplary embodiment, the spray gun container cover 2191 is designed to be essentially conical so that the spray gun container cover 2191 is supported especially well on the holding area 1267 of the plate-shaped adapter 1203. In order to allow the spray gun container cover 2191 to be arranged with a catch-type connection on the plate-shaped adapter 1203, the spray gun container cover 2191 has a first catch web and a second catch web 2162 also on its conical outside, cooperating with corresponding catch web holders 1270 and 1271 (see FIG. 22, for example) of the plate-shaped adapter 1203. To connect the spray gun container cover 2191 with the spray gun container 2101, the spray gun container 2102 has an outside thread 2197 with which the spray gun container 2102 is screwed onto the spray gun container cover 2191. It is self-evident that the spray gun container cover 2191 has a corresponding inside thread (not shown here) for this purpose. The outside thread 2197 and the inside thread (not shown further here) of the spray gun container cover 2191 are designed so that the spray gun container cover 2191 can be attached to the spray gun container 2102 by means of a quarter turn about its longitudinal axis 2198. To do so, the spray gun container cover 2191 is first placed on the spray gun container 2102 and then rotated clockwise about its longitudinal axis 2198. The spray gun container 2102 has a locking mechanism 3000 in the area of the outside thread 2197. By means of this locking mechanism 3000, it is possible to ensure that the spray gun container cover 2191 can be arranged on the spray gun container 2102 in such a way that they cannot be separated from one another unintentionally when the spray gun container cover 2191 with its first catch web 2161 and with its second catch web 2162 are engaged or disengaged by means of a rotational motion in corresponding catch web receptacles 1270 and 1271 of the plate-shaped adapter 1203. The locking mechanism 3000 advantageously prevents the connection between the outside thread 2197 of the spray gun container 2102 and the corresponding inside thread of the spray gun container cover 2191 from becoming loosened unintentionally in such an engagement movement. This reduces the risk of the spray gun container 2102 dropping down from the spray gun container cover 2191 in the worst case. In this exemplary embodiment the locking mechanism 3000 is designed so that it can be unlocked again. To do so, it is usually sufficient to "press" accordingly from the outside in the area of the locking mechanism 3000. Unlocking is especially advantageous if the present spray gun container 2102 and the respective spray gun container cover 2191 are designed to be reusable.

However, the spray gun container 2202 (see FIG. 32) has a locking mechanism 3010 that cannot be unlocked again, contrary to the above. The spray gun container cover 2291 has essentially the same design as the spray gun container cover 2191 from FIG. 31. The spray gun container cover 2291 is designed to be conical and has a main opening 2294 by means of which the spray gun container cover 2291 is preferably arranged on a plate-shaped adapter 1203 (see FIG. 28). To obtain a particularly secure grip on this plate-shaped adapter 1203, the spray gun container cover 2291 has a first catch web 2261 and a second catch web 2262 which communicate with corresponding catch web receptacles 1270 and 1271 (see FIG. 22) in the plate-shaped adapter 1203.

The catch mechanism 3010 has a first peripheral elevation 3020 and a second peripheral elevation 3030. The interior area of the spray gun container cover 2291 which communicates with the locking mechanism 3010 also has such elevations and/or grooves communicating with the peripheral elevations 3020 and 3030. In a simple design variant, the spray gun container cover 2291 has a simple undercut on the side facing the spray gun container 2202, engaging behind the respective elevation 3020 and/or 3030 on the locking mechanism 3010 when the spray gun container cover 2291 is pressed onto the spray gun container 2202. The embodiment of the lock mechanism 3010 shown here can no longer be unlocked because the locking mechanism 3010 shown here acts essentially like a closure on a cable binder which is generally known. The spray gun container cover 2291 therefore cannot be released from the spray gun container 2202 again. Therefore, the locking mechanism 3010 shown here is primarily suitable for disposable components which are disposed of after one use and are not to be cleaned again for further use. In order for the spray gun container 2202 not to become twisted with respect to the spray gun container 2191 when the spray gun container cover 2291 is situated on a spray gun 101 or preferably on a plate-shaped adapter 1203, the locking mechanism 3010 has a fixation mechanism 3040 arranged essentially across the peripheral elevations 3020 and 3030. In this exemplary embodiment, the fixation mechanism 3040 is a web which interacts with a corresponding groove (not shown explicitly here) on the inside of the spray gun container cover 2291. When the spray gun container cover 2291 is placed on the spray gun container 2202, the spray gun container cover 2291 is brought up to the spray gun container 2202 in the direction of the arrow 3050 and pressed so tightly against it that the two components become locked together.

Both the spray gun container 2102 and the spray gun container 2202 can be filled especially advantageously when they are set down on a supporting surface 3100. In such a position, the respective spray gun container cover 2191 and/or 2291 may be arranged securely on the spray gun container 2102 and/or 2202 provided for this purpose.

While the invention has been illustrated and described as embodied in a spray gun container, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. A spray gun container comprising:

a bottom and a sidewall defining a paint holding cup with a top opening, a cover for covering the top opening and constructed for operational connection to a spray gun such that in a working position paint held in the paint holding cup flows from a bottom area in the direction of an opening in the cover for release through the spray gun, wherein the bottom has an additional opening configured as a passageway and arranged exterior of the bottom for providing an air supply to the paint holding area, a stopper held captive exterior of the bottom and removably received in the passageway for a fluidtight fit such that when the passageway is closed, the interior of the bottom is a flat surface; wherein the cover is provided with a screen for filtering the paint before it reaches the spray gun.

2. The spray gun container of claim 1, wherein the cover is connected to the paint holding cup, by a coupling ring.

3. The spray gun container according to claim 1, wherein the paint holding cup is a single-walled spray gun container for attachment, to a spray gun by an adapter.

4. The spray gun container according to claim 3, wherein the adapter is attached to the cover by a bayonet connection.

5. The spray gun container according to claim 3, wherein the cover is provided with a web extending circumferentially at least partially around the adapter.

6. The spray gun container according to claim 5, wherein the web is in the form of a ring.

7. The spray gun container according to claim 6, wherein the web is made of an elastic material.

8. The spray gun container according to claim 1, wherein the additional opening is provided with a conical channel or the passageway is provided with a conical collar.

9. The spray gun container according to claim 1, wherein the passageway tapers to a passageway opening facing away from the bottom.

10. The spray gun container according to claim 1, wherein the bottom has a nipple on which the stopper is arranged.

11. The spray gun container according to claim 1, wherein the stopper is directly molded onto the bottom.

12. The spray gun container according to claim 1, wherein the stopper has an outside diameter which corresponds substantially to an inside diameter of the passageway.

13. The spray gun container according to claim 1, wherein the stopper is molded at the bottom.

14. A spray gun container comprising:

a bottom and a sidewall defining a paint holding cup with a top opening, a cover for covering the top and constructed for operational connection to a spray gun such that in a working position paint held in the paint holding cup flows from a bottom area in the direction of an opening in the cover for release through the spray gun, wherein the bottom has an additional opening configured as a passageway and arranged exterior of the bottom for providing an air supply to the paint holding area, a stopper held captive exterior of the bottom adjacent the passageway and removably received in the passageway for a fluidtight fit such that when the passageway is closed, the interior of the bottom is a flat surface;

wherein the sidewall extends beyond the bottom to a height to exceed the stopper to thereby form a peripheral collar that acts as a stand for the spray gun container, wherein the cover is provided with a screen for filtering the paint before it reaches the spray gun.

15. The spray gun container according to claim 14, wherein the stopper has an outside diameter which corresponds substantially to an inside diameter of the passageway.

* * * * *